US010914130B1

(12) United States Patent
Mueller et al.

(10) Patent No.: US 10,914,130 B1
(45) Date of Patent: Feb. 9, 2021

(54) STRIPPER HEAD SYSTEM AND METHOD OF USE

(71) Applicant: Mueller Rental, Inc., Yorktown, TX (US)

(72) Inventors: Harvey Mueller, Yorktown, TX (US); Jeremy Kneese, Yorktown, TX (US)

( * ) Notice: Subject to any disclaimer, the term of this patent is extended or adjusted under 35 U.S.C. 154(b) by 0 days.

(21) Appl. No.: 16/273,114

(22) Filed: Feb. 11, 2019

Related U.S. Application Data

(60) Provisional application No. 62/628,677, filed on Feb. 9, 2018.

(51) Int. Cl.
*E21B 33/06* (2006.01)
*E21B 33/12* (2006.01)

(52) U.S. Cl.
CPC ..... *E21B 33/06* (2013.01); *E21B 33/12* (2013.01); *E21B 33/1208* (2013.01); *E21B 33/1212* (2013.01)

(58) Field of Classification Search
CPC ..... E21B 33/06; E21B 33/03; E21B 33/1208; E21B 33/1212; E21B 33/12
See application file for complete search history.

(56) References Cited

U.S. PATENT DOCUMENTS 4,500,094 A * 2/1985 Biffle ..... E21B 33/085 175/214
5,178,215 A * 1/1993 Yenulis ..... E21B 33/085 166/95.1
5,647,444 A * 7/1997 Williams ..... E21B 33/085 166/84.1
5,848,643 A * 12/1998 Carbaugh ..... E21B 33/085 166/85.4
6,530,430 B2 * 3/2003 Reynolds ..... E21B 19/006 166/346
2013/0032359 A1 * 2/2013 Riggs ..... F16L 23/10 166/378
2015/0376970 A1 * 12/2015 Hughes ..... E21B 33/085 166/84.1

* cited by examiner

*Primary Examiner* — Yong-Suk (Philip) Ro
(74) *Attorney, Agent, or Firm* — Shannon Warren

(57) ABSTRACT

A stripper head assembly for holding back pressure while stripping work-strings in and out of pressurized well environments, wherein, the stripper head assembly comprises a stripper head, a stripper insert, a stripper rubber, and one or more retention pins. The stripper head comprises an outer portion of the stripper head assembly. The stripper head comprises, from top to bottom, a top portion, a body portion, a lower neck portion and a flange base. A portion of the stripper insert fits within a portion of the stripper rubber. A portion of the stripper rubber fits within a portion of the stripper head. A portion of one or more bolts attaches to a portion of the stripper head.

17 Claims, 17 Drawing Sheets

STRIPPER HEAD SYSTEM AND METHOD OF USE

CROSS-REFERENCE TO RELATED APPLICATIONS

This application claims benefit to U.S. Patent Application No(s). 62/628,677 filed on Feb. 9, 2018.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

In one embodiment, stripper head assembly 100 can be used to hold back pressure while stripping work-strings in and out of pressurized well environments. Said stripper head assembly 100 can also aid in wellsite operations including horizontal drill-outs, rig assisted snubbing, reverse circulation, and sonic stimulation.

BRIEF SUMMARY OF THE INVENTION

A stripper head assembly for holding back pressure while stripping work-strings in and out of pressurized well environments, wherein, said stripper head assembly comprises a stripper head, a stripper insert, a stripper rubber, and one or more retention pins. Said stripper head comprises an outer portion of said stripper head assembly. Said stripper head comprises, from top to bottom, a top portion, a body portion, a lower neck portion and a flange base. A portion of said stripper insert fits within a portion of said stripper rubber. A portion of said stripper rubber fits within a portion of said stripper head. A portion of one or more bolts attaches to a portion of said stripper head. A portion of one or more retention pin sleeves fits within a portion of said stripper head. A portion of said one or more retention pins fits within a portion of said one or more retention pin sleeves. Said stripper rubber comprises a rubber material. Said one or more retention pins selectively slide into one or more retention apertures of said stripper head and press into a side portion of said stripper insert to hold said stripper insert and said stripper rubber within said stripper head. Said stripper rubber comprises a form fitting element for use within said stripper head assembly being defined with: a lower aperture and an upper aperture at either end of a center aperture, an inner surface around an interior space comprising said center aperture, a collar portion attaching to an upper mid portion. Said upper mid portion comprising a substantially cylindrical hollow element for selectively being held within an inner sidewall of said stripper insert, a lubrication groove cut into a portion of a lower portions, a shoulder extending out from said upper mid portion to form a lower mid portion, a seal lip comprising an outwardly extending material comprising a pressure trap between said lower mid portion and said lower portions, said lower portions extending down toward said lower aperture and forming a multi-stage loading zones, and said multi-stage loading zones configured to directing pressures so as to enhance the seal of said stripper rubber within said stripper head assembly.

DETAILED DESCRIPTION OF THE INVENTION

Figure 1:
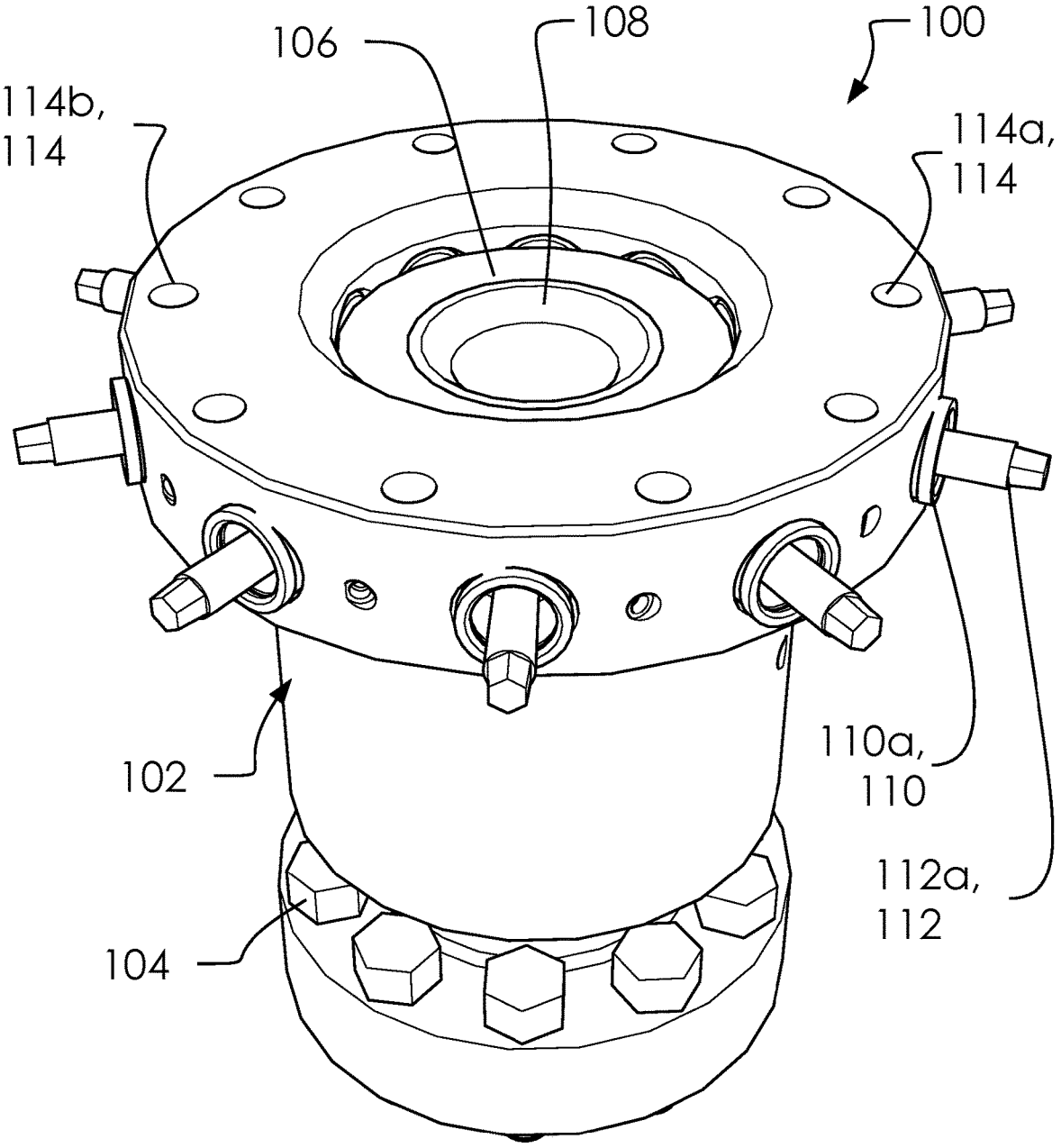
FIG. 1 illustrates an elevated overview view of a stripper head assembly 100.

FIG. 1 illustrates an elevated overview view of a stripper head assembly 100.

In one embodiment, said stripper head assembly 100 can comprise a stripper head 102, one or more bolts 104, a stripper insert 106, one or more retention pin sleeves 110, a stripper rubber 108, said one or more retention pin sleeves 110, one or more retention pins 112, and a one or more mating apertures 114.

In one embodiment, said one or more bolts 104 can comprise a first bolt 104*a*, a second bolt 104*b*, a third bolt 104*c*, a fourth bolt 104*d*, a fifth bolt 104*e*, a sixth bolt 104*f*, a seventh bolt 104*g*, an eighth bolt 104*h*, a ninth bolt 104*k* and a tenth bolt 104*m*.

In one embodiment, said one or more retention pin sleeves 110 can comprise a first retention pin sleeve 110*a*, a second retention pin sleeve 110*b*, a third retention pin sleeve 110*c*, a fourth retention pin sleeve 110*d*, a fifth retention pin sleeve 110*e*, a sixth retention pin sleeve 110*f*, a seventh retention pin sleeve 110*g*, an eighth retention pin sleeve 110*h*, a ninth retention pin sleeve 110*k* and a tenth retention pin sleeve 110*m*.

In one embodiment, said one or more retention pins 112 can comprise a first retention pin 112*a*, a second retention pin 112*b*, a third retention pin 112*c*, a fourth retention pin 112*d*, a fifth retention pin 112*e*, a sixth retention pin 112*f*, a seventh retention pin 112*g*, an eighth retention pin 112*h*, a ninth retention pin 112*k* and a tenth retention pin 112*m*.

In one embodiment, said one or more mating apertures 114 can comprise a first mating aperture 114*a*, a second mating aperture 114*b*, a third mating aperture 114*c*, a fourth mating aperture 114*d*, a fifth mating aperture 114*e*, a sixth mating aperture 114*f*, a seventh mating aperture 114*g*, an eighth mating aperture 114*h*, a ninth mating aperture 114*k* and a tenth mating aperture 114*m*. In one embodiment, said one or more mating apertures 114 can be used to mate said stripper head assembly 100 with equipment such as a snubbing unit, hooks for lifting or similar.

In one embodiment, said one or more retention pin sleeves 110 can comprise said second retention pin sleeve 110*b*, said third retention pin sleeve 110*c*, said fourth retention pin sleeve 110*d*, said fifth retention pin sleeve 110*e*, said sixth retention pin sleeve 110*f*, said seventh retention pin sleeve 110*g*, said eighth retention pin sleeve 110*h*, said ninth retention pin sleeve 110*k*, and said tenth retention pin sleeve 110*m*.

As illustrated, only said first retention pin sleeve 110*a* is labeled. However, others among said one or more retention pin sleeves 110 are illustrated throughout the figures and are arranged in a rotary pattern around said stripper head 102. Likewise, only said first retention pin 112*a* among said one or more retention pins 112 is illustrated, and said first mating aperture 114*a* and said second mating aperture 114*b* among said one or more mating apertures 114 are illustrated.

In one embodiment, said stripper head assembly 100 can be used to hold back pressure while stripping work-strings in and out of pressurized well environments. Said stripper head assembly 100 can also aid in wellsite operations including horizontal drill-outs, rig assisted snubbing, reverse circulation, and sonic stimulation.

Said one or more retention pins 112 can be threaded. In one embodiment, said one or more retention pins 112 can be configured to hold said stripper head assembly 100 in place.

Said stripper head assembly 100 can be designed and built to meet API 16A.

Said stripper head assembly 100 can comprise said stripper rubber 108. Said stripper rubber 108 can comprise a self-energized seal that becomes reinforced as wellbore pressure increases within the pressure rating range.

Further, said stripper head assembly 100 can fit to a snubbing unit, as is known in the art.

Figure 2A:
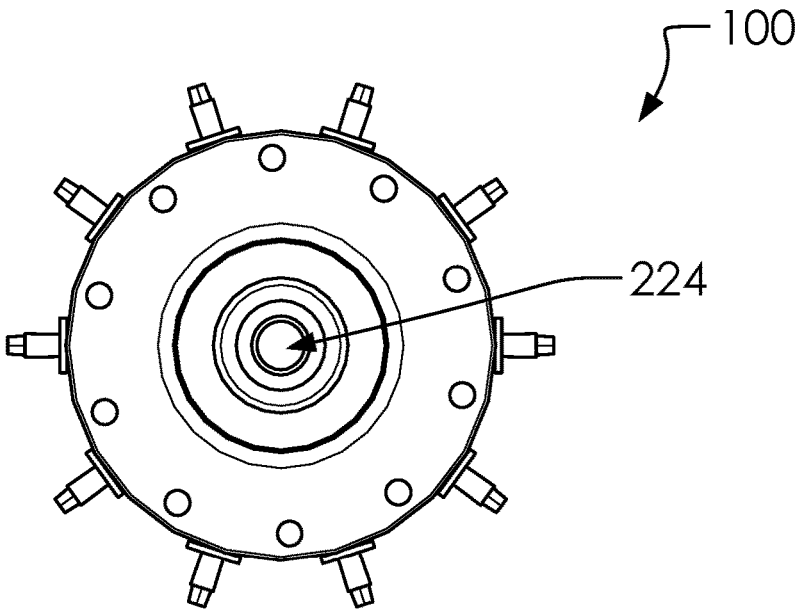
FIGS. 2A and 2B illustrate an elevated top side view and an elevated front side view of said stripper head assembly 100.
Figure 2B:
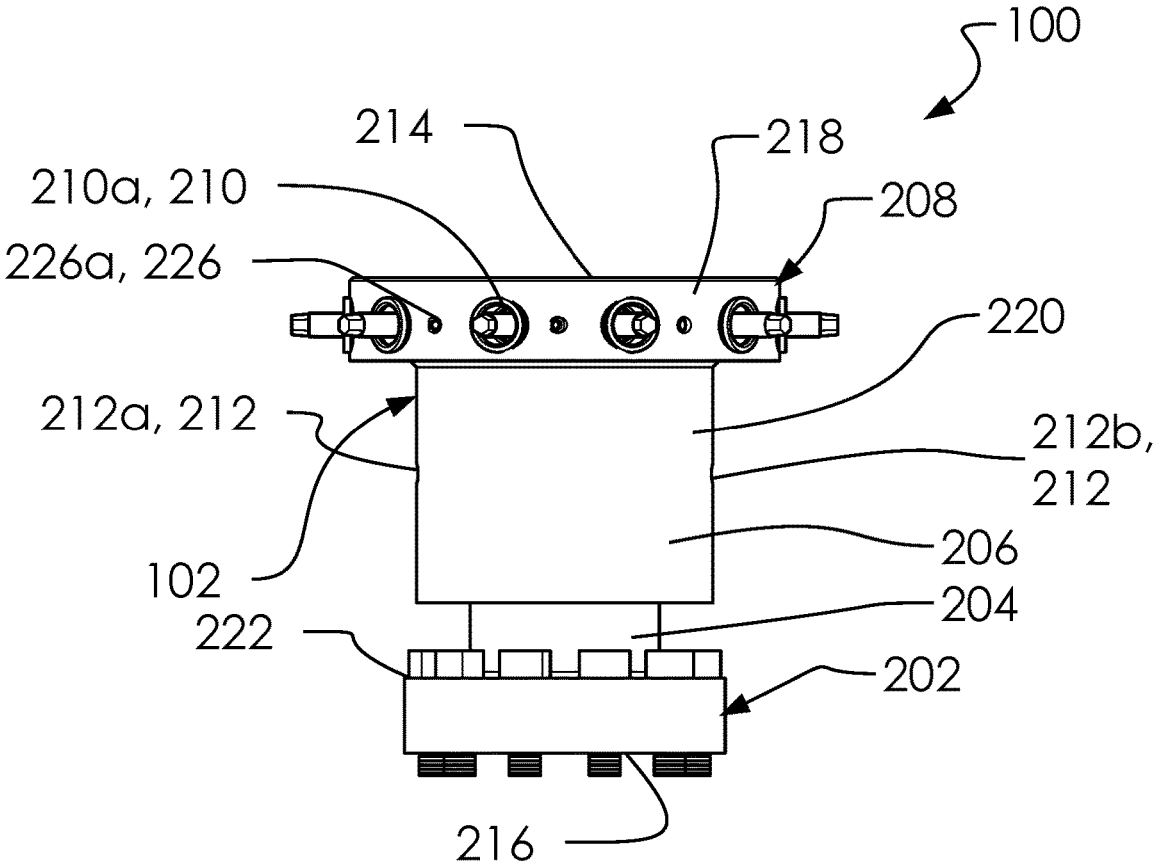

FIGS. 2A and 2B illustrate an elevated top side view and an elevated front side view of said stripper head assembly 100.

In one embodiment, a flange base 202 can comprise a bottom surface 216 and a top surface 222.

In one embodiment, a body portion 206 can comprise one or more NPT (National Pipe Thread) outlets 212 and a side surface 220.

In one embodiment, a top portion 208 can comprise one or more retention apertures 210, a top surface 214 and one or more grease ports 226.

Said one or more retention apertures 210 can comprise a first retention aperture 210*a*, a second retention aperture 210*b*, a third retention aperture 210*c*, a fourth retention aperture 210*d*, a fifth retention aperture 210*e*, a sixth retention aperture 210*f*, a seventh retention aperture 210*g*, an eighth retention aperture 210*h*, a ninth retention aperture 210*k* and a tenth retention aperture 210*m*.

In one embodiment, said one or more NPT outlets 212 can comprise a first NPT outlet 212*a* and a second NPT outlet 212*b*. In one embodiment, said one or more NPT outlets 212 can be arranged around said side surface 220 of said stripper head 102. In one embodiment, said one or more NPT outlets 212 can be used for pressure equalization and bleed-off.

Said one or more grease ports 226 can comprise a first grease port 226*a*, a second grease port 226*b*, a third grease port 226*c*, a fourth grease port 226*d*, a fifth grease port 226*e*, a sixth grease port 226*f*, a seventh grease port 226*g*, an eighth grease port 226*h*, a ninth grease port 226*k* and a tenth grease port 226*m*.

In one embodiment, said stripper head 102 can comprise an outer portion of said stripper head assembly 100. Said stripper head 102 can comprise, from top to bottom, said top portion 208, said body portion 206, a lower neck portion 204 and said flange base 202. In one embodiment, said stripper head 102 can comprise a series of substantially cylindrical parts being adapted for use as a snubbing unit, as is known in the art.

As illustrated, only a portion of said one or more retention apertures 210 and said one or more grease ports 226 are labeled. However, each are arranged around a center aperture 224 in a rotary pattern wherein, each unlabeled part can be determined by a person in the art.

Figure 3:
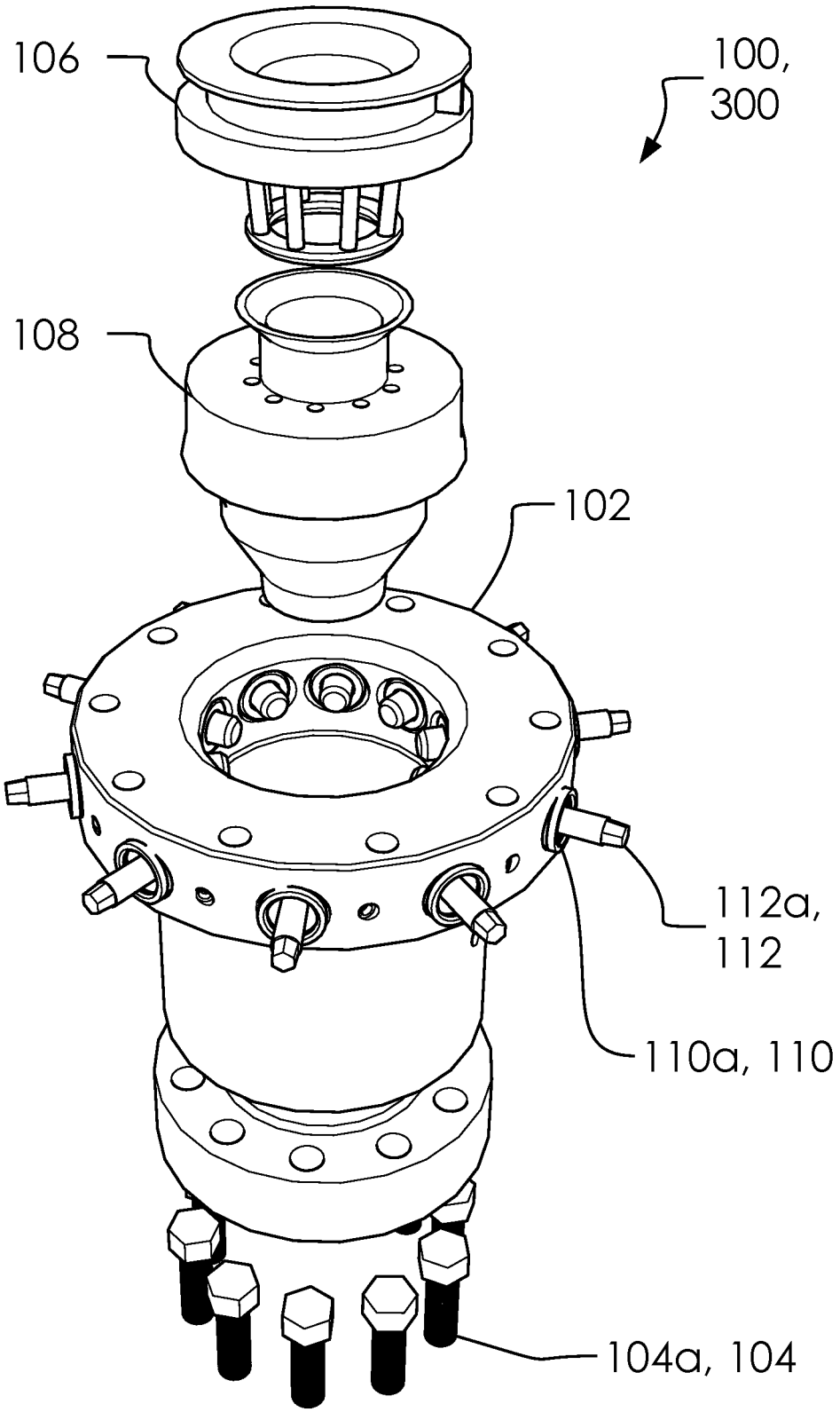
FIG. 3 illustrates a perspective overview view of said stripper head assembly 100 exploded.

FIG. 3 illustrates a perspective overview view of said stripper head assembly 100 exploded.

As illustrated, said stripper head assembly 100 can comprise several components which selectively nest within one another. For example, in one embodiment, a portion of said stripper insert 106 can fit within a portion of said stripper rubber 108; a portion of said stripper rubber 108 can fit within a portion of said stripper head 102; a portion of said one or more bolts 104 can attach to a portion of said stripper head 102; a portion of said one or more retention pin sleeves 110 fit within a portion of said stripper head 102; and a portion of said one or more retention pins 112 fit within a portion of said one or more retention pin sleeves 110.

In one embodiment, said stripper insert 106 can be molded into said stripper rubber 108. In one embodiment, these parts can be bonded together through an injected rubber molding process. In one embodiment, these can be bonded through injection transfer, compression, or molding process.

In one embodiment, said stripper head 102, said one or more bolts 104, said one or more retention pin sleeves 110 and said one or more retention pins 112 can be constructed of metals such as steel. In one embodiment, said stripper rubber 108 can comprise rubber.

Figure 4A:
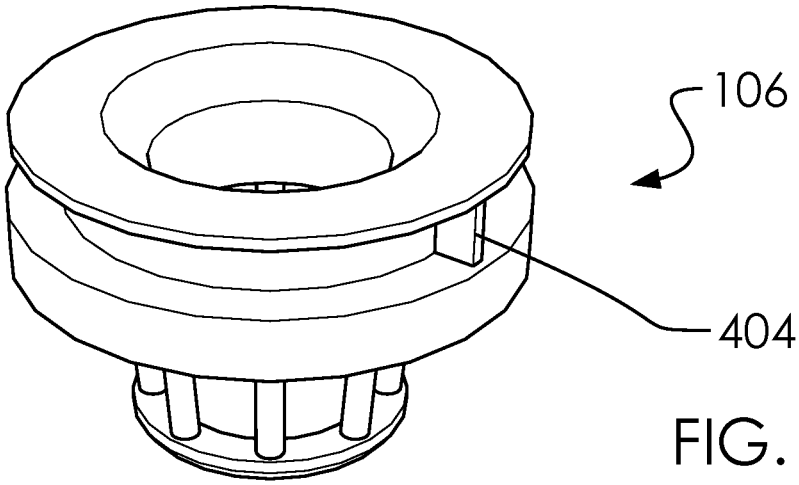
FIGS. 4A, 4B and 4C illustrate an elevated top side view, a perspective bottom side view and a perspective overview of a stripper insert 106.
Figure 4B:
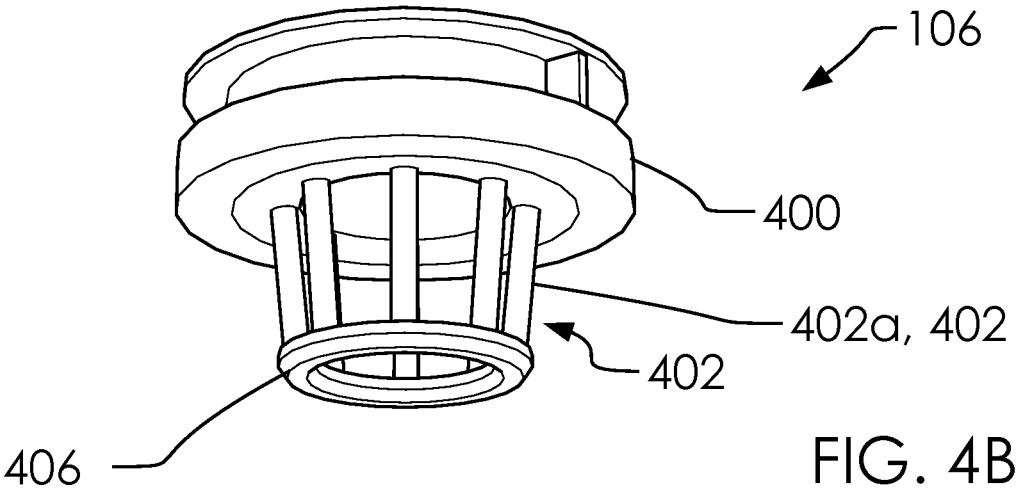
Figure 4C:
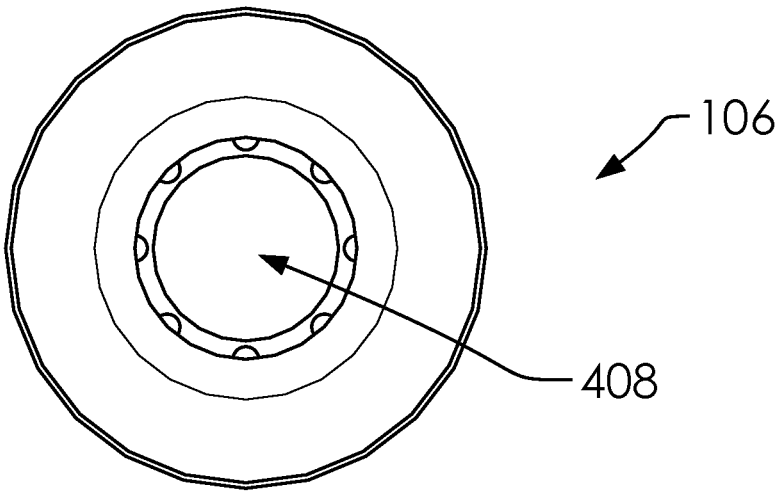

FIGS. 4A, 4B and 4C illustrate an elevated top side view, a perspective bottom side view and a perspective overview of said stripper insert 106.

In one embodiment, one or more stalks 402 can comprise a first stalk 402*a*, a second stalk 402*b*, a third stalk 402*c*, a fourth stalk 402*d*, a fifth stalk 402*e*, a sixth stalk 402*f*, a seventh stalk 402*g* and an eighth stalk 402*h*.

From top to bottom, said stripper insert 106 can comprise an insert upper ring 400, said one or more stalks 402, and an insert lower ring 406.

In one embodiment, said stripper insert 106 can fit within a portion of said stripper rubber 108; wherein, said one or more stalks 402 and said insert lower ring 406 can nest within said stripper rubber 108 as described and illustrated herein.

In one embodiment, said one or more stalks 402 can comprise cylindrical elements expending down from a lower portion of said insert upper ring 400. In one embodiment, said insert lower ring 406 can comprise a portion of said insert upper ring 400 having been cut away. In one embodiment, said insert lower ring 406 can comprise a substantially circular element adapted to prevent movement of said stripper insert 106 relative to said stripper rubber 108 once attached thereto.

In one embodiment, said insert upper ring 400 can comprise an anti-rotation tab 404 adapted to prevent rotation of said stripper insert 106 with a portion of said one or more retention pins 112 inserted into a portion of said insert upper ring 400.

In one embodiment, said stripper insert 106 can comprise a center aperture 408, as illustrated.

In one embodiment, said insert upper ring 400, said one or more stalks 402, said anti-rotation tab 404 and said insert lower ring 406 can be welded to one another.

Figure 5A:
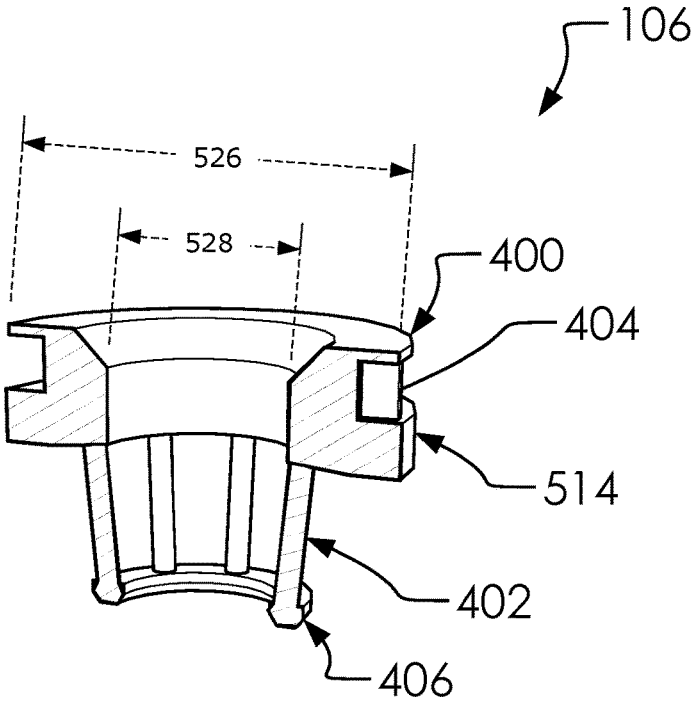
FIGS. 5A and 5B illustrate a cross-section elevated front side view and perspective overview of said stripper insert 106.
Figure 5B:
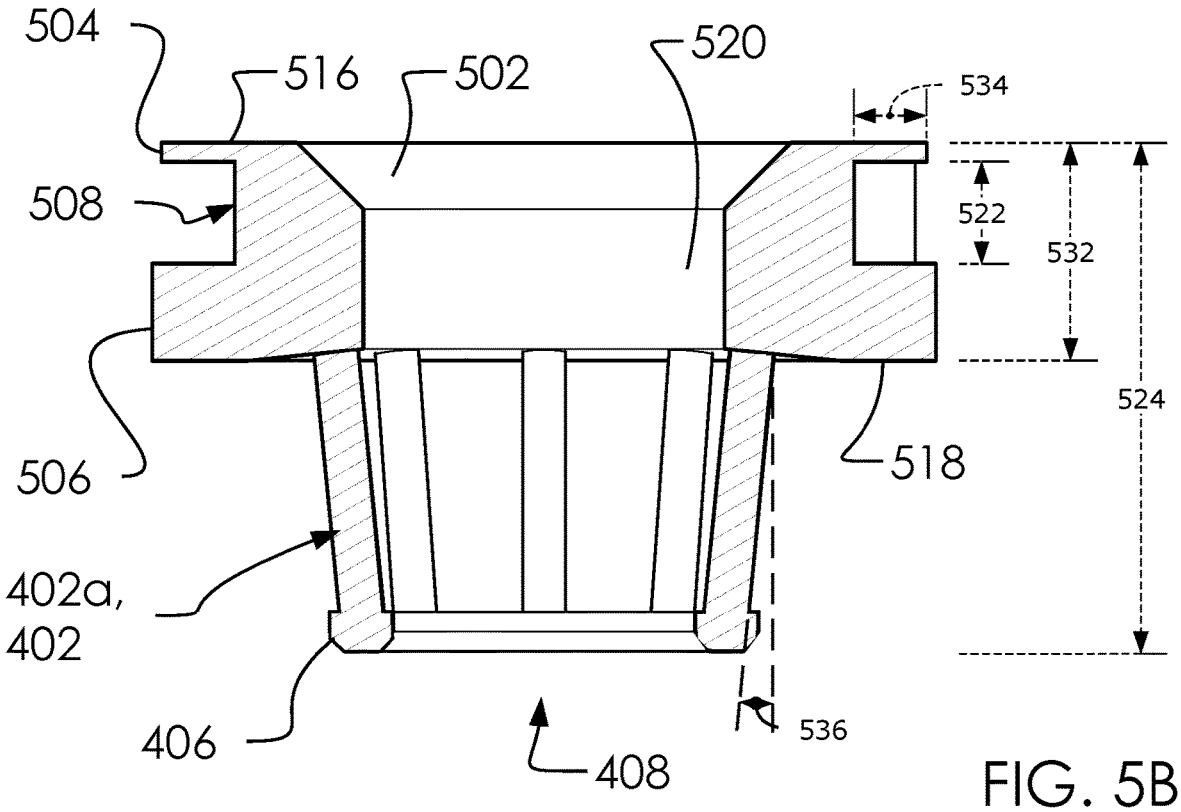

FIGS. 5A and 5B illustrate a cross-section elevated front side view and perspective overview of said stripper insert 106.

Said insert upper ring 400 can comprise a substantially cylindrical shape with said center aperture 408 cutting through a horizontal central axis. Said insert upper ring 400 can comprise an outer sidewall 514, a top surface 516, a bottom surface 518, an inner sidewall 520, and a height 532. In one embodiment, said outer sidewall 514 can comprise an indention 508 having a height 522 and a depth 534. In one embodiment, said outer sidewall 514 can be divided into an upper portion 504, a lower portion 506 and said indention 508; wherein, said indention 508 can comprise a disc shaped cut out of said insert upper ring 400 between said upper portion 504 and said lower portion 506, as illustrated.

In one embodiment, said center aperture 408 of said insert upper ring 400 can comprise a beveled interior edge 502 at a surface between said top surface 516 and said inner sidewall 520; In one embodiment, said top surface 516 can be substantially horizontal, and said inner sidewall 520 can be substantially vertical.

In one embodiment, said center aperture 408 can comprise an internal diameter 528; and said insert upper ring 400 can comprise an external diameter 526.

In one embodiment, said insert upper ring 400 can comprise a cylindrical ring defined by said outer sidewall 514, said top surface 516, said bottom surface 518 and said inner sidewall 520. Said beveled interior edge 502 can comprise an angular cut into said inner sidewall 520 between said top surface 516 and said inner sidewall 520. Said indention 508 can comprise a cut into said outer sidewall 514 to define said indention 508 with said upper portion 504 above said indention 508 and said lower portion 506 below said indention 508.

Said anti-rotation tab 404 can be inserted into a portion of said indention 508 to block off a portion of said indention 508. In one embodiment, a plurality of said anti-rotation tab 404 can be used, as needed. In one embodiment, said anti-rotation tab 404 can be welded into a portion of said indention 508.

In one embodiment, said insert lower ring 406 can be attached to said insert upper ring 400 with said one or more stalks 402 fixed at rotary intervals there-between.

In one embodiment, said one or more stalks 402 can attach to said bottom surface 518 at one end and said insert lower ring 406 at another end.

In one embodiment, said center aperture 408 can extend through said inner sidewall 520 and an inner sidewall 530 of said insert lower ring 406.

In one embodiment, said one or more stalks 402 can be arranged at a stalk angle 536 inward and down toward said center aperture 408 to provide an interference fit of said stripper head assembly 100 when no pressure is applied to the system and to provide a press said stripper rubber 108 in ward when under pressure.

Figure 6A:
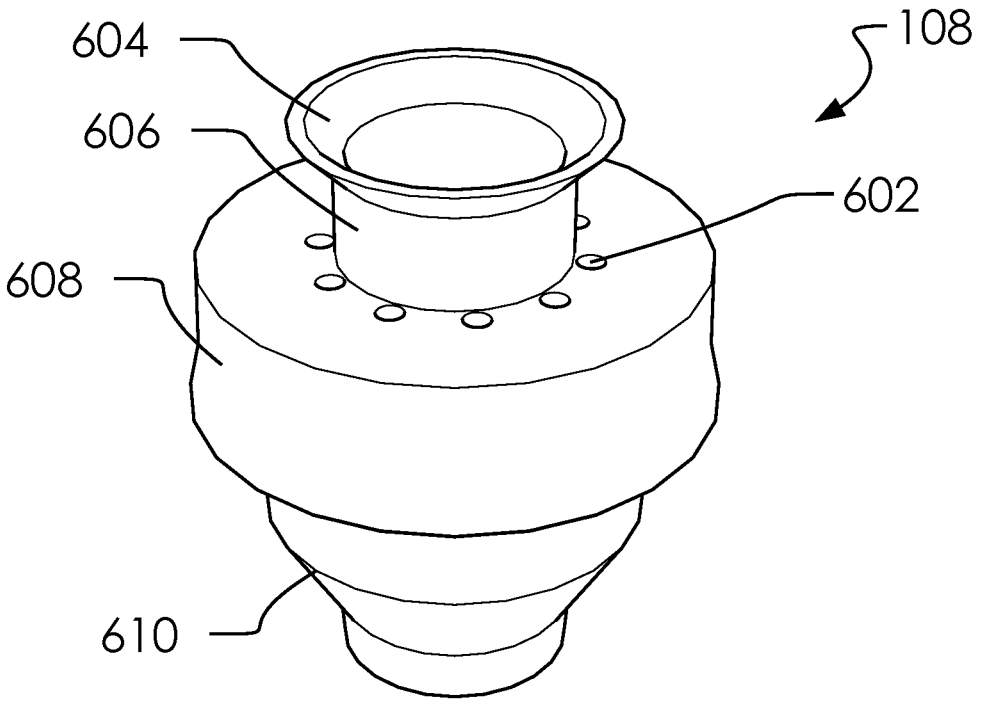
FIGS. 6A and 6B illustrate a perspective overview view and an elevated top side view of a stripper rubber 108.
Figure 6B:
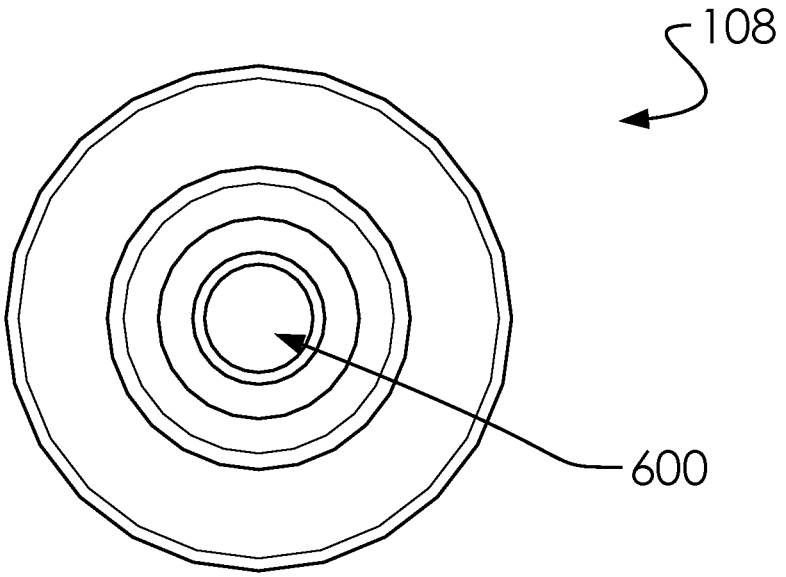

FIGS. 6A and 6B illustrate a perspective overview view and an elevated top side view of said stripper rubber 108.

Said stripper rubber 108 can comprise a rubber material for sealing parts of said stripper head assembly 100.

Said stripper rubber 108 can comprise one molded item with several features which can comprise (listed from top to bottom): a collar portion 604, an upper mid portion 606, a lower mid portion 608 and a lower portions 610. Said stripper rubber 108 can comprise a center aperture 600 to allow fluids to pass through said stripper rubber 108.

In one embodiment, said stripper rubber 108 can comprise a series of substantially cylindrical parts being arranged at various diameters to fill spaces within said stripper head 102 and said stripper insert 106 as discussed herein.

A stalks aperture 602 can comprise a space which (if assembled), said stripper insert 106 would be molded into said stripper rubber 108.

Figure 7A:
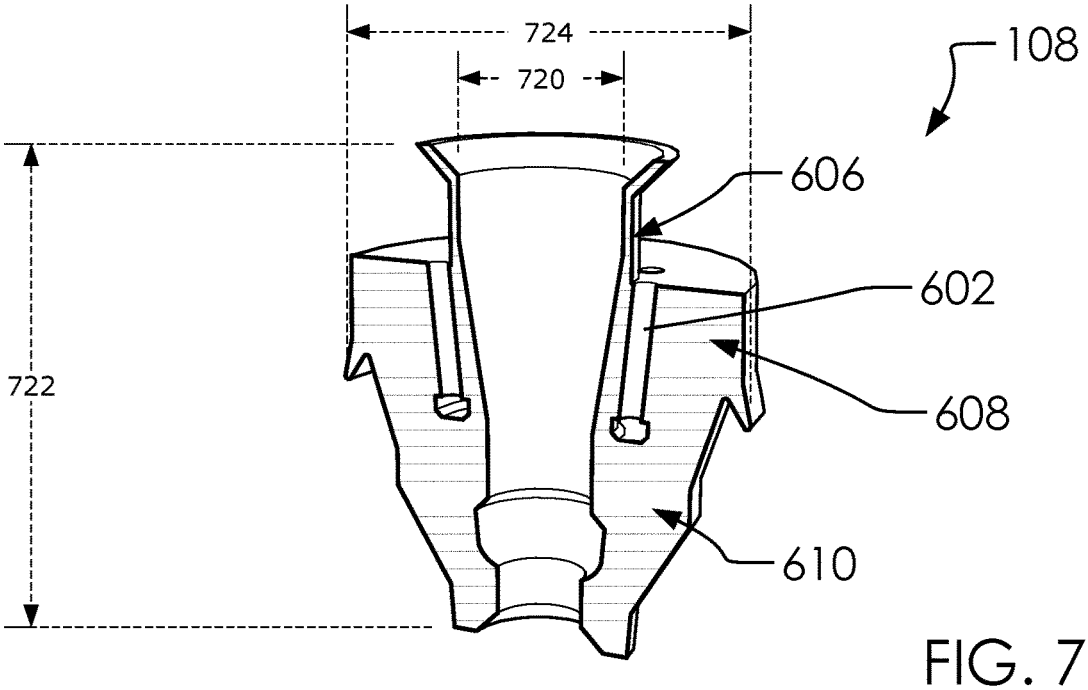
FIGS. 7A and 7B illustrate a perspective overview view in cross-section view and an elevated front side view of said stripper rubber 108
Figure 7B:
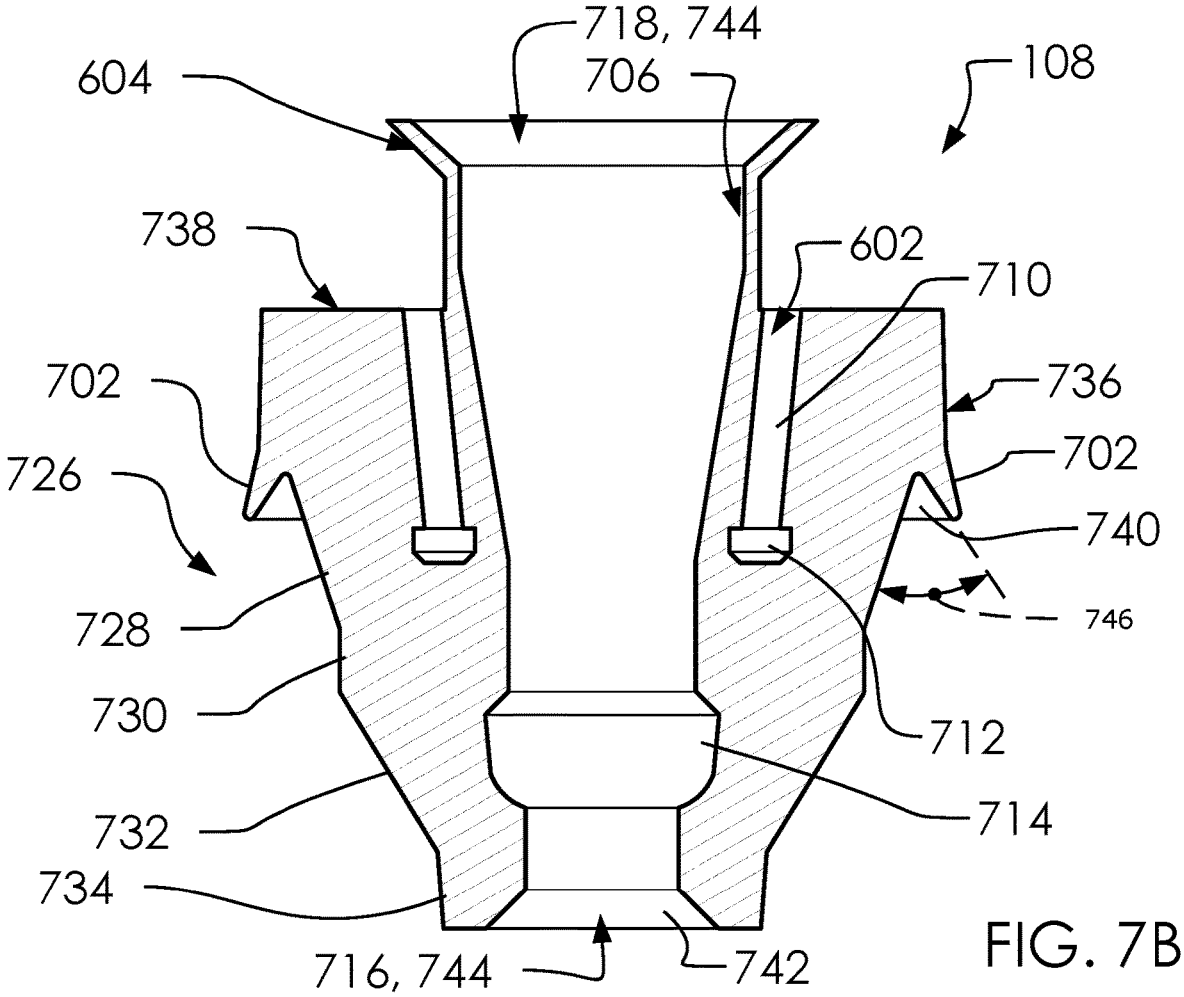

FIGS. 7A and 7B illustrate a perspective overview view in cross-section view and an elevated front side view of said stripper rubber 108

Said stripper rubber 108 can comprise a central aperture 744 along a horizontal central axis. Said central aperture 744 can comprise a lower aperture 716 and an upper aperture 718.

In one embodiment, said collar portion 604 of said stripper rubber 108 can comprise a diameter 720 at said upper aperture 718. In one embodiment, said collar portion 604 can flare out and upward away from said upper mid portion 606, as illustrated.

In one embodiment, said upper mid portion 606 of said stripper rubber 108 can comprise wrap around a portion of said stripper insert 106.

Said stalks aperture 602 can be formed by molding said one or more stalks 402 into said stripper rubber 108.

In one embodiment, said stripper rubber 108 can comprise a form fitting element for use within said stripper head assembly 100 being defined with said lower aperture 716 and said upper aperture 718 at either end of said center aperture 600; an inner surface 706 around an interior space comprising said center aperture 600; said collar portion 604 attaching to said upper mid portion 606; said upper mid portion 606 comprising a substantially cylindrical hollow element for selectively being held within said inner sidewall 520 of said stripper insert 106; a lubrication groove 714 cut into a portion of said lower portions 610; a shoulder 738 extending out from said upper mid portion 606 to form said lower mid portion 608; a seal lip 702 comprising an outwardly extending material comprising a pressure trap 740 between said lower mid portion 608 and said lower portions 610; said lower portions 610 extending down toward said lower aperture 716 and forming a multi-stage loading zones 726; and said multi-stage loading zones 726 configured to directing pressures so as to enhance the seal of said stripper rubber 108 within said stripper head assembly 100.

In one embodiment, said pressure trap 740 can comprise an internal taper 746. In one embodiment, said internal taper 746 can create an early seal with an internal surface 1202 of said stripper head 102. In this manner, said pressure trap 740 can be self-energized to press said seal lip 702 into said internal surface 1202. In one embodiment, said seal lip 702 can have enough initial contact to create the initial seal which can then hold. Self-energized can mean that said stripper rubber 108 need not be compressed or squeezed at installation to create the initial seal, rather it need only be inserted into said stripper head 102.

Existing systems are designed only to hold up to 2500 psi of pressure, whereas, said stripper head assembly 100 can hold many times more than that. Many design advantages are seen in this disclosure, including innovations in said stripper rubber 108.

Said internal taper 746 of said pressure trap 740 can tighten under pressure as said pressure trap 740 will enhance a seal with said internal surface 1202 under pressure.

In one embodiment, said multi-stage loading zones 726 can build its hold on a tubing within said stripper head assembly 100 by increasing the cross-section thickness of said stripper rubber 108 as said multi-stage loading zones 726 increase from a first stage 734 to a second stage 732 to a third stage 730 to a fourth stage 728. likewise, the relative angle of said fourth stage 728 and said second stage 732 convert pressure into inward force on tubing. Finally, pressure on said fourth stage 728 can assert pressure on said insert lower ring 406 and said one or more stalks 402 within said stripper rubber 108.

Figure 8:
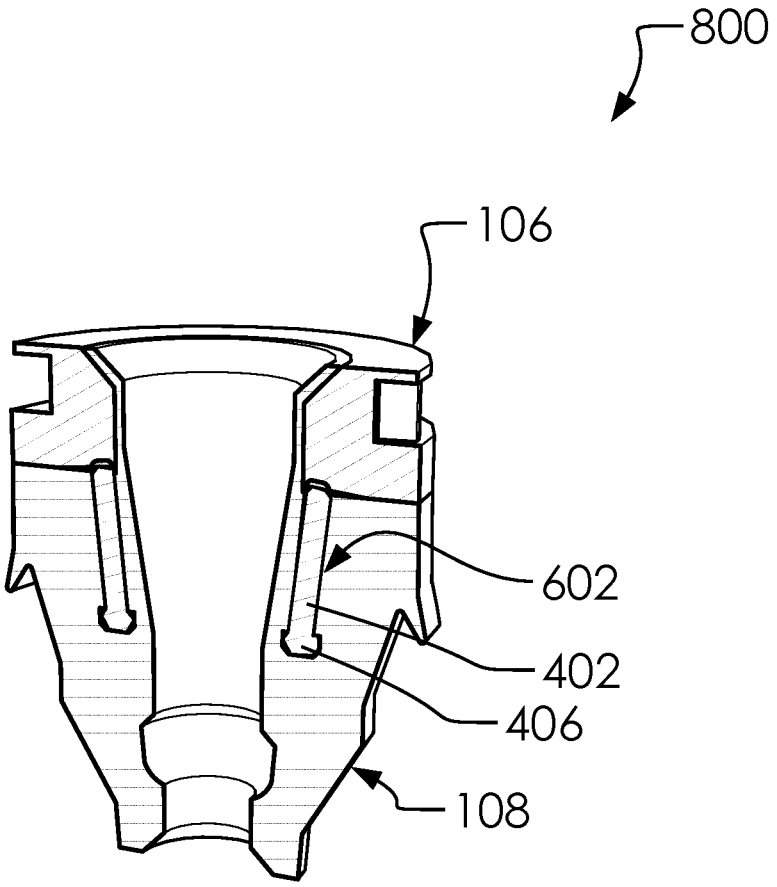
FIG. 8 illustrates a perspective overview view of said stripper insert 106 and said stripper rubber 108.

FIG. 8 illustrates a perspective overview view of said stripper insert 106 and said stripper rubber 108.

In one embodiment, an inner portions 800 can comprise said stripper insert 106 and said stripper rubber 108 attached to one another. In one embodiment, said inner portions 800 can be assembled by molding a portion of said stripper insert 106 into a portion of said stripper rubber 108. In one embodiment, a portion of said insert lower ring 406 and said one or more stalks 402 can be molded into said stalks aperture 602.

Figure 9A:
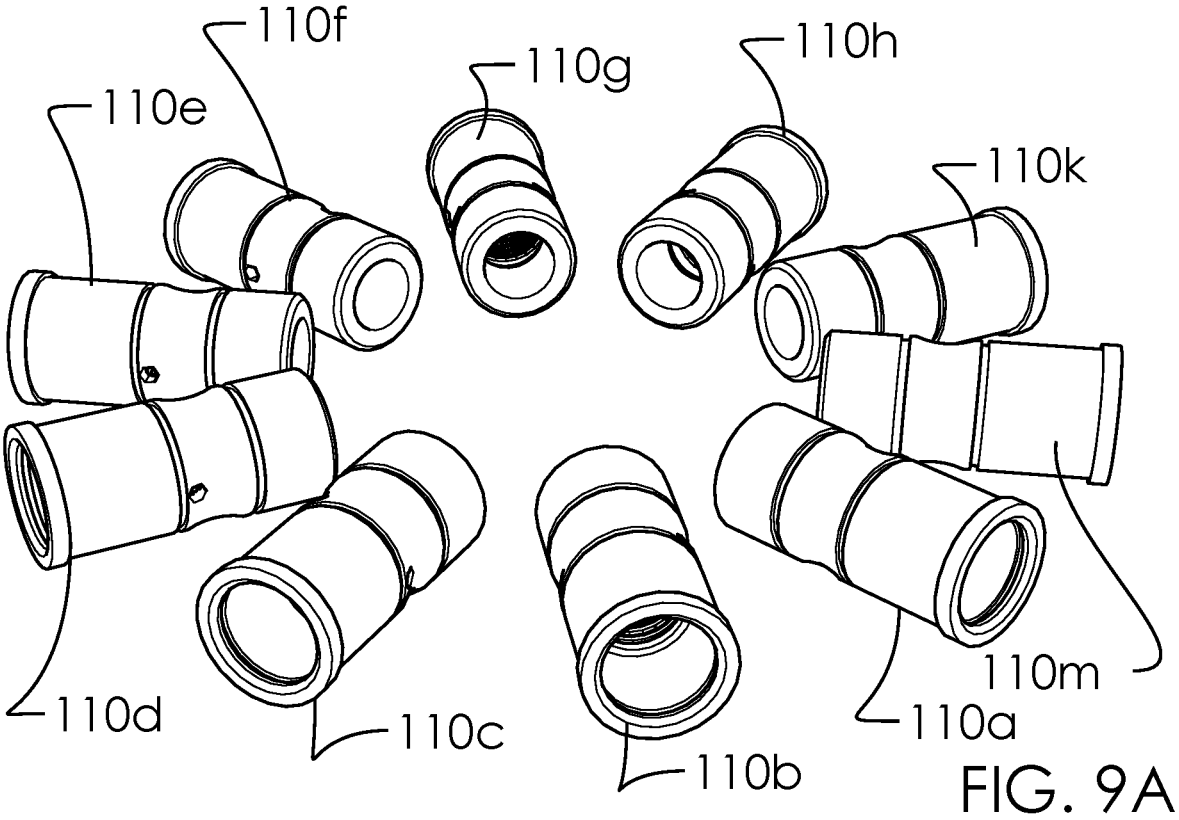
FIG. 9A illustrates a perspective overview view of a stripper head 102 in cross-section view with one or more retention pin sleeves 110.
Figure 9B:
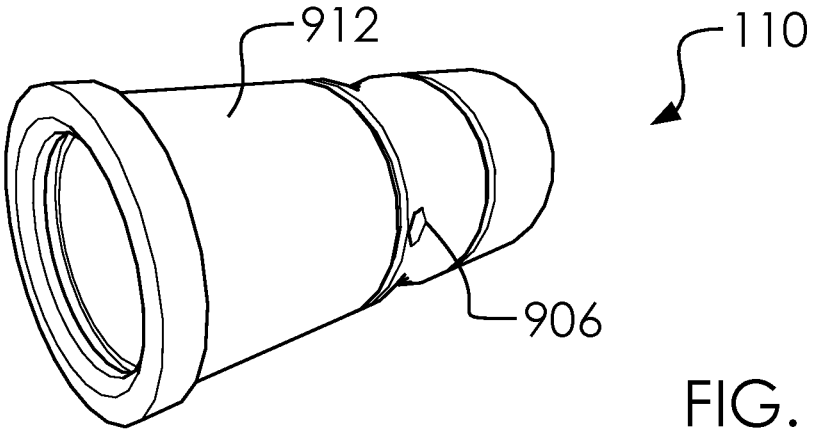
FIG. 9B illustrates a perspective back side view of said one or more retention pin sleeves 110.
Figure 9C:
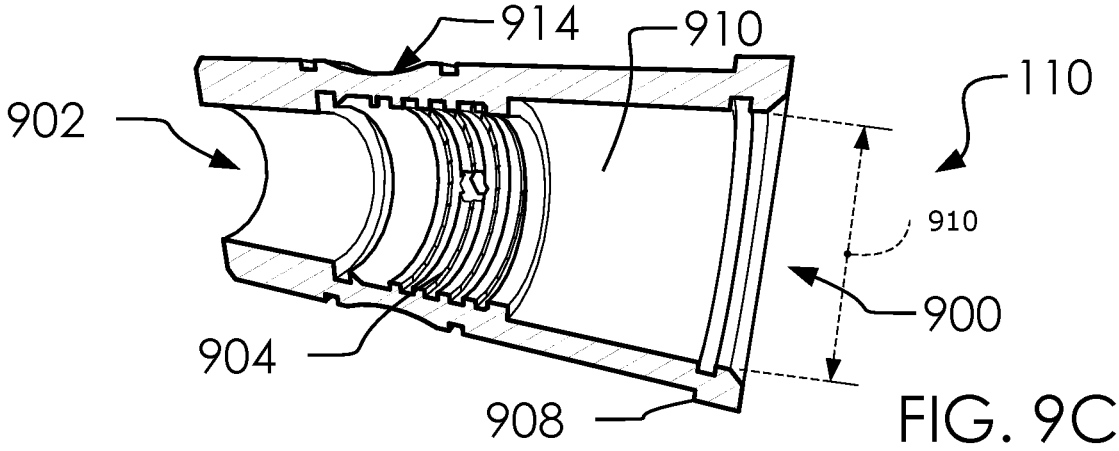
FIG. 9C illustrates a perspective front side view of said one or more retention pin sleeves 110.

FIG. 9A illustrates a perspective overview view of said stripper head 102 in cross-section view with said one or more retention pin sleeves 110. FIG. 9B illustrates a perspective back side view of said one or more retention pin sleeves 110. FIG. 9C illustrates a perspective front side view of said one or more retention pin sleeves 110.

In one embodiment, each among said one or more retention pin sleeves 110 can comprise an outer aperture 900, an inner aperture 902, an internal threading 904, a grease aperture 906, an internal diameter 908, an inner wall 910, an outer wall 912, and a belly 914.

Said grease aperture 906 can be configured to allow lubricant into said one or more retention pin sleeves 110 to protect said one or more retention pin sleeves 110 and said one or more retention pins 112.

In one embodiment, said one or more retention pin sleeves 110 can be selectively attached to said stripper head 102 by welding them one to another. In one embodiment, said one or more retention pin sleeves 110 can comprise a wearable and replaceable part thereby allowing said stripper head assembly 100 to be repaired if said internal threading 904 fail.

Said outer aperture 900 can refer to a portion of said one or more retention pin sleeves 110 being arranged outside of said stripper head 102 when installed; likewise, said inner aperture 902 can be arranged inside of said stripper head 102.

Said one or more retention pin sleeves 110 can each comprise a cylindrical hollow sleeve with said outer aperture 900 and said inner aperture 902 at its ends. In one embodiment, said internal threading 904 can be arranged around said inner wall 910. In one embodiment, said internal threading 904 can be half way between said outer aperture 900 and said inner aperture 902. In one embodiment, said grease aperture 906 can be an aperture to connect said inner wall 910 and said outer wall 912, and comprise an aperture which cuts through a portion of said internal threading 904.

In one embodiment, said belly 914 can comprise a generally round indention in said outer wall 912. In one embodiment, said belly 914 can be aligned with said internal threading 904; where said belly 914 is indented into said outer wall 912 and said internal threading 904 is in said inner wall 910.

Figure 10A:
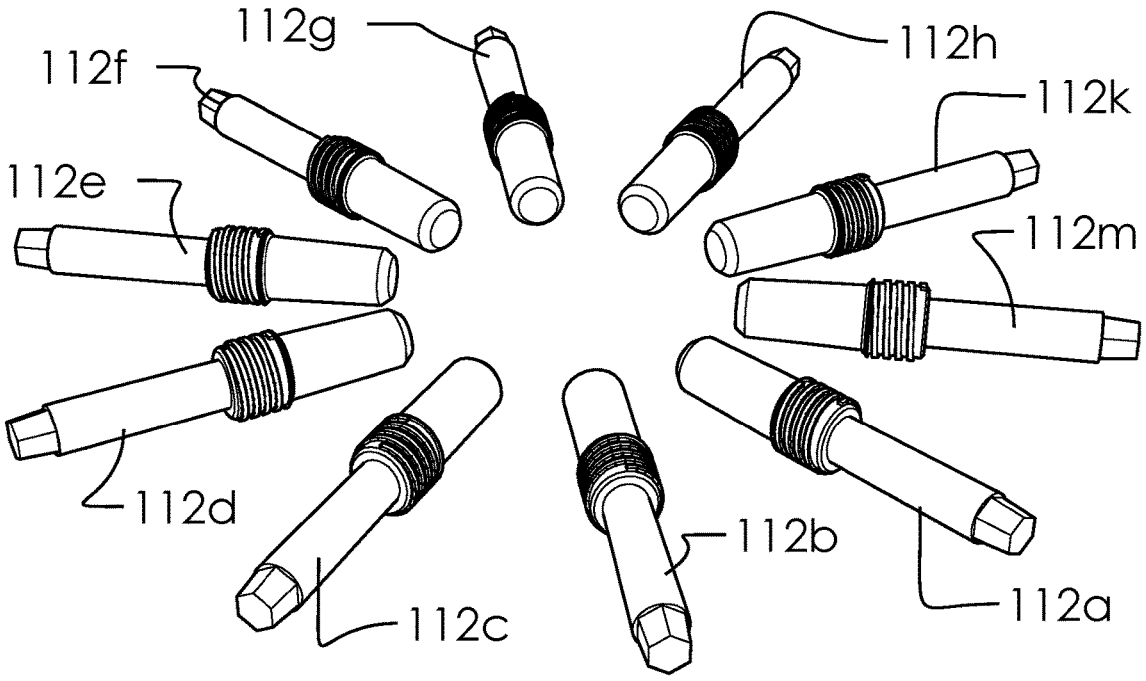
FIG. 10A illustrates a perspective overview view of said one or more retention pin sleeves 110.
Figure 10B:
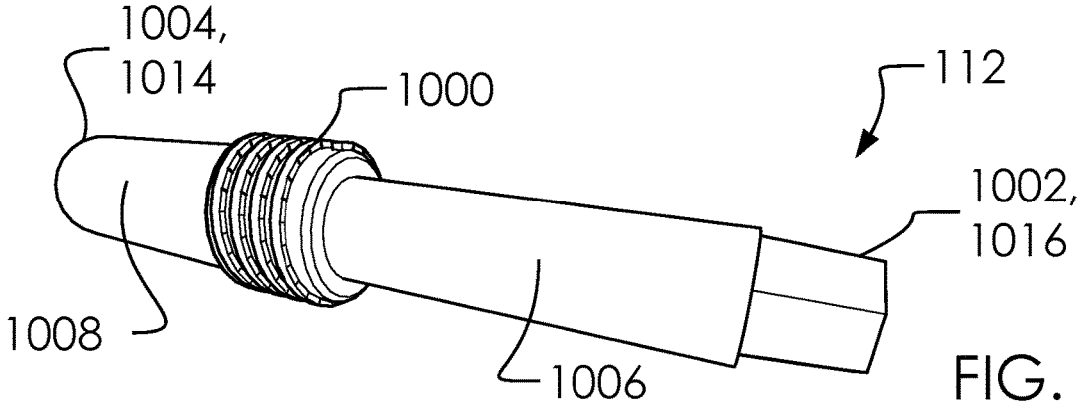
FIGS. 10B and 10C illustrate a perspective overview view of one or more retention pins 112 and a cross-section view thereof.
Figure 10C:
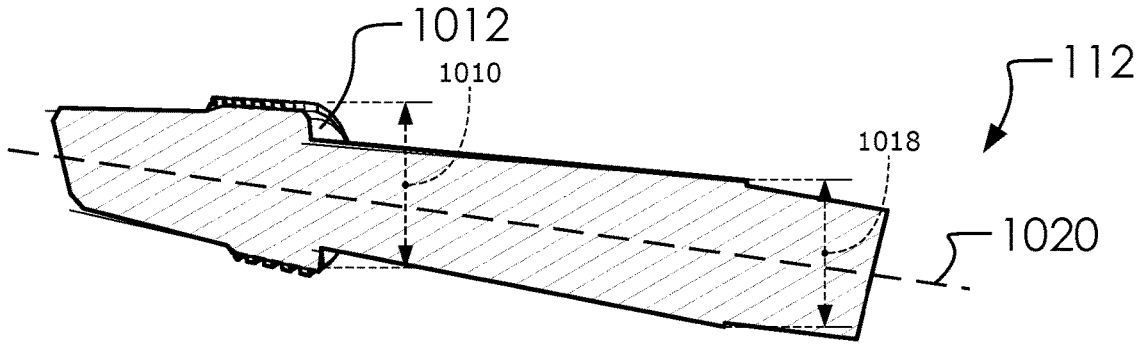

FIG. 10A illustrates a perspective overview view of said one or more retention pin sleeves 110. FIGS. 10B and 10C illustrate a perspective overview view of said one or more retention pins 112 and a cross-section view thereof.

In one embodiment, each among said one or more retention pins 112 can comprise an external threading 1000, a drive head 1002, a pressing head 1004, a exterior portion body 1006, an interior portion body 1008, an interior end diameter 1010, a shoulder 1012, an internal end 1014, an external end 1016 and an exterior end diameter 1018.

In one embodiment, said external threading 1000 can selectively mate with said internal threading 904. Said external threading 1000 can be arranged between said internal end 1014 and said external end 1016. In one embodiment, said external threading 1000 can be on said interior portion body 1008 proximate to said shoulder 1012. In one embodiment, said interior end diameter 1010 can be larger than said exterior end diameter 1018; wherein, the step down in diameter between said interior end diameter 1010 and said exterior end diameter 1018 can create said shoulder 1012. In one embodiment, said internal end 1014 and said external end 1016 can be substantially cylindrical and aligned on a central axis 1020.

Said one or more retention pins 112 can comprise said drive head 1002 for attachment to a driving tool, such as a wrench. In one embodiment, said drive head 1002 can comprise a helical cross-section.

In one embodiment, said interior end diameter 1010 can be smaller than said internal diameter 908.

Figure 11A:
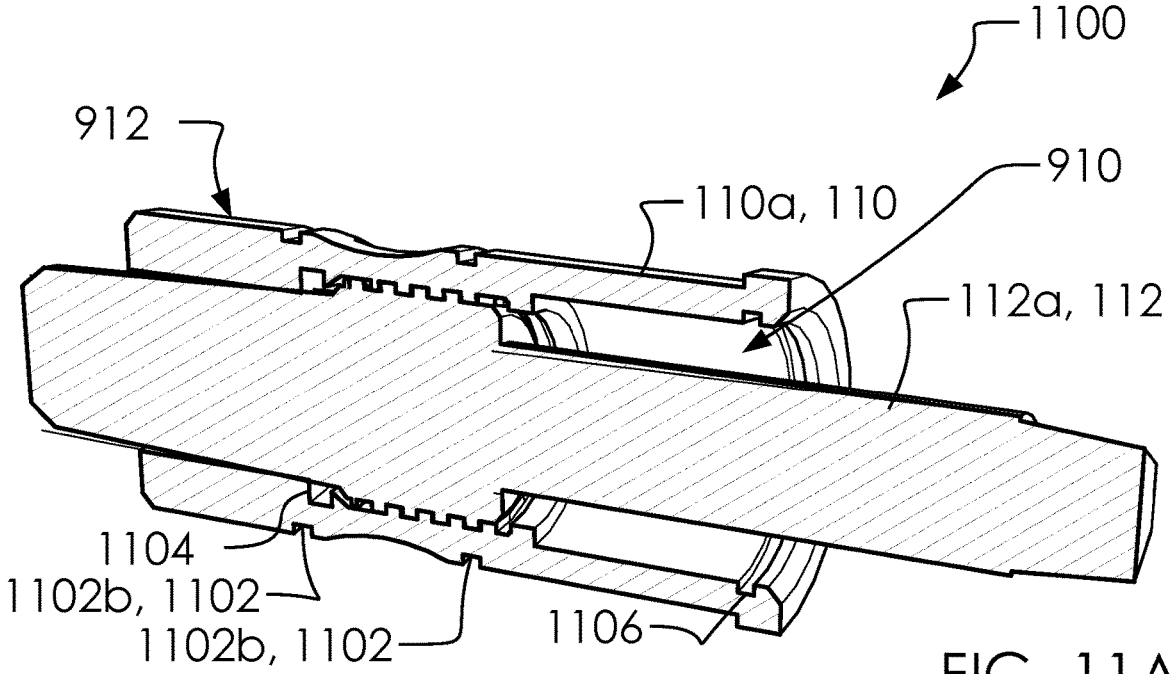
FIGS. 11A and 11B illustrate a perspective overview view of one or more bolts 104, and an elevated front side view of an attached configuration 1100, respectively.
Figure 11B:
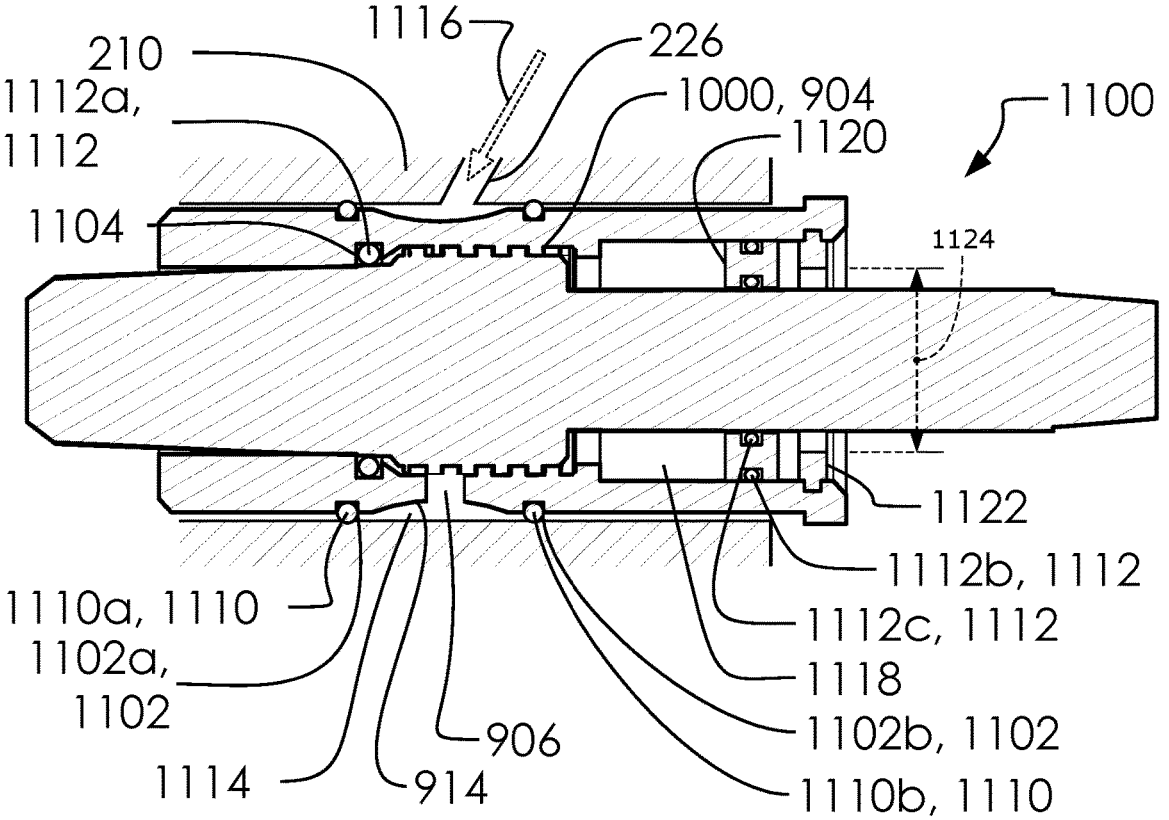

FIGS. 11A and 11B illustrate a perspective overview view of said one or more bolts 104, and an elevated front side view of an attached configuration 1100, respectively.

Said attached configuration 1100 can comprise said one or more retention pin sleeves 110 attached to said one or more retention pins 112.

In one embodiment, said one or more retention pins 112 can selectively slide into said one or more retention pin sleeves 110 and selectively attach thereto by screwing said external threading 1000 into said internal threading 904.

Said outer wall 912 can comprise a one or more exterior O-ring grooves 1102. Said one or more exterior O-ring grooves 1102 can comprise a first exterior O-ring groove 1102*a* and a second exterior O-ring groove 1102*b*. Said inner wall 910 can comprise an interior O-ring groove 1104 and a snap ring groove 1106.

In one embodiment, said one or more retention pin sleeves 110 and said one or more retention pins 112 can be substantially sealed with one another with a one or more O-rings 1108. In one embodiment, said one or more O-rings 1108 can be configured to fit into said one or more exterior O-ring grooves 1102 and said interior O-ring groove 1104. In one embodiment, a two or more exterior O-rings 1110 can fit into said one or more exterior O-ring grooves 1102 (which can comprise said first exterior O-ring groove 1102*a* and a first exterior O-ring 1110*a* being paired and said second exterior O-ring groove 1102*b* and a second exterior O-ring 1110*b* being paired, as illustrated). Likewise, a first interior O-ring 1112*a* of a two or more interior O-rings 1112 can fit into said interior O-ring groove 1104.

In one embodiment, said attached configuration 1100 can comprise a grease cavity 1114 between said two or more exterior O-rings 1110, said belly 914, said top portion 208. Said grease cavity 1114 can be configured to receive a lubricant 1116 (such as grease or other lubricants) from said one or more grease ports 226 into said grease cavity 1114. Said grease cavity 1114 thereafter can be aligned with said grease aperture 906 in said one or more retention pin sleeves 110 to allow said lubricant 1116 to pass into a space between said external threading 1000, said internal threading 904 and said two or more interior O-rings 1112 comprising a threading internal grease cavity 1118.

Accordingly, said one or more retention pin sleeves 110, said one or more retention pins 112 and said top portion 208 are engineered to allow said lubricant 1116 to be inserted into threading between said one or more retention pin sleeves 110 and said one or more retention pins 112 without allowing said lubricant 1116 to spill inside of said stripper head 102.

In one embodiment, each among said one or more retention pin sleeves 110 can further comprise a bushing 1120 and a snap ring 1122. In one embodiment, said bushing 1120 can comprise an "H" shaped cross-section which can comprise O-ring grooves comprising a second interior O-ring 1112*b* and a third interior O-ring 1112*c*. In one embodiment, said bushing 1120 can comprise a stopper at a forward position of said threading internal grease cavity 1118 between said one or more retention pin sleeves 110 and said one or more retention pins 112, as illustrated. In one embodiment, said snap ring 1122 can fit into said snap ring groove 1106 and prevent said bushing 1120 from sliding out and opening said threading internal grease cavity 1118.

In one embodiment, said bushing 1120 can comprise an internal diameter 1124. In one embodiment, said internal diameter 1124 can be smaller than said interior end diameter 1010 of said shoulder 1012 of said one or more retention pins 112. Accordingly, said snap ring 1122 can retain said bushing 1120 and said one or more retention pins 112.

Figure 12:
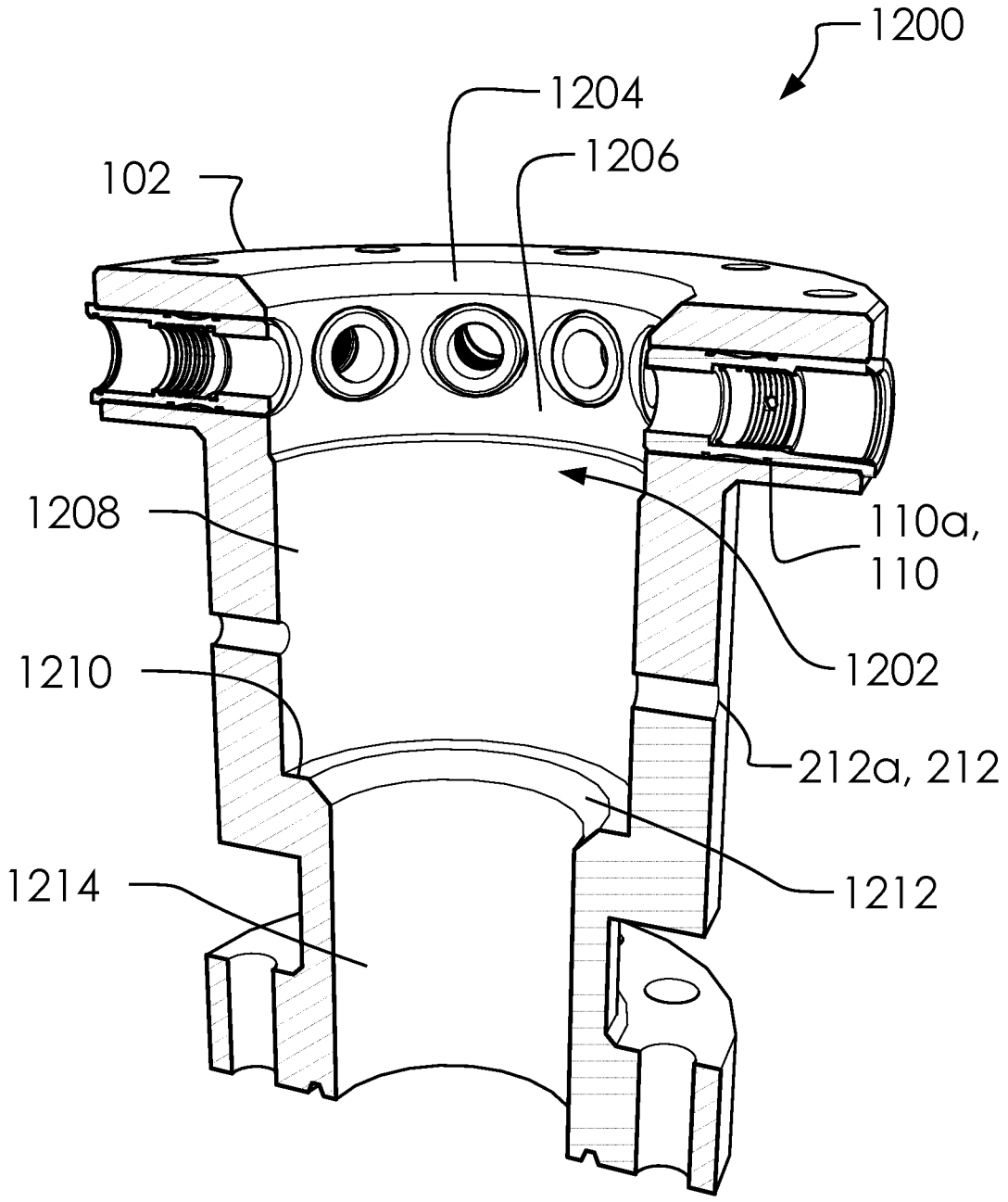
FIG. 12 illustrates a perspective overview view of said one or more retention pins 112.

FIG. 12 illustrates a perspective overview view of said one or more retention pins 112.

In one embodiment, said one or more retention pin sleeves 110 can be welded into said stripper head 102 in said one or more retention apertures 210.

In one embodiment, said stripper head 102 can comprise said internal surface 1202. In one embodiment, said internal surface 1202 can progress (from to bottom) as: a beveled upper edge 1204, a first surface 1206, a second surface 1208, a third surface 1210, a lower beveled edge 1212 and a fourth surface 1214.

As is known in the art, said beveled upper edge 1204 can allow pipe and tubing to enter said stripper head assembly 100 so as to minimize damage to said stripper head assembly 100 or the tubing. Further, said collar portion 604 can be aligned above said beveled upper edge 1204 to further protect the equipment.

In one embodiment, said first surface 1206 can be slightly larger than said second surface 1208; wherein, said second surface 1208 can taper in so as to create a more solid seal between said stripper head 102 and said stripper rubber 108, as illustrated herein.

Said third surface 1210 can comprise a step inward and said lower beveled edge 1212 can be beveled, as illustrated. Finally, said fourth surface 1214 can be the smallest diameter of said internal surface 1202. In one embodiment, said fourth surface 1214 can fit with equipment mounted below said stripper head assembly 100.

Figure 13:
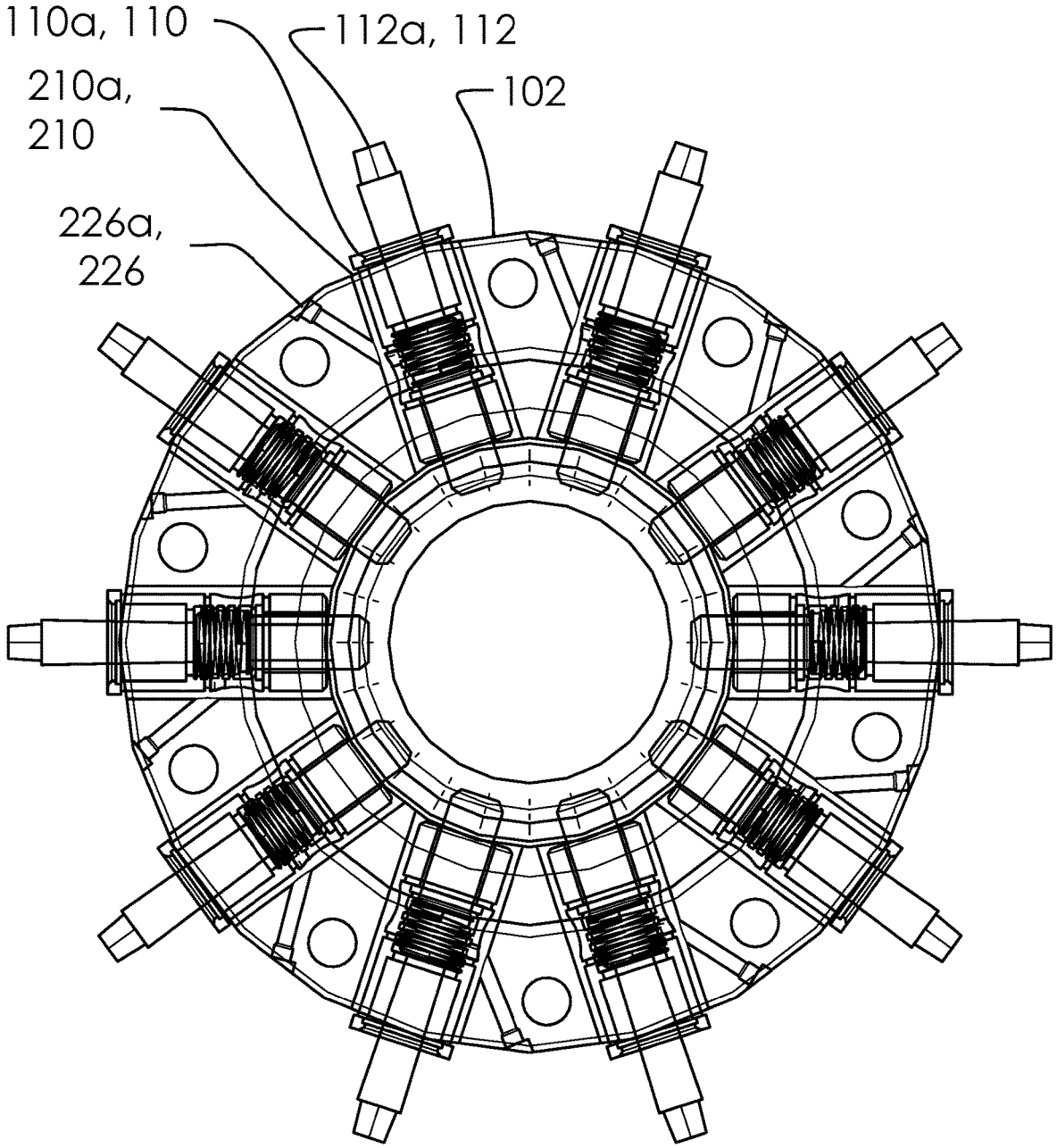
FIG. 13 illustrates a perspective overview view of a first retention pin sleeve 110*a* and a first retention pin 112*a* in cross-section view.

FIG. 13 illustrates a perspective overview view of said first retention pin sleeve 110*a* and said first retention pin 112*a* in cross-section view.

In one embodiment, said one or more grease ports 226 can provide a passage into said one or more retention apertures 210 so that said stripper head assembly 100 can receive said lubricant 1116 which can be delivered into said one or more grease ports 226, into said one or more retention apertures 210, through said grease aperture 906 and between said external threading 1000 and said internal threading 904.

Figure 14:
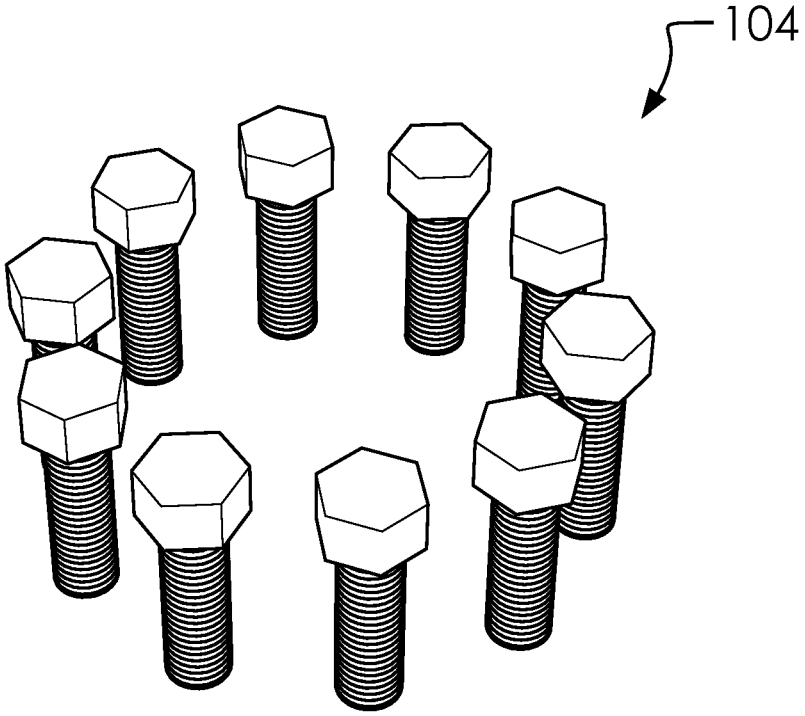
FIG. 14 illustrates a perspective overview view of said stripper head assembly 100 in cross-section view.

FIG. 14 illustrates a perspective overview view of said stripper head assembly 100 in cross-section view.

In one embodiment, said one or more bolts 104 can comprise API studs, as is known in the art.

Figure 15:
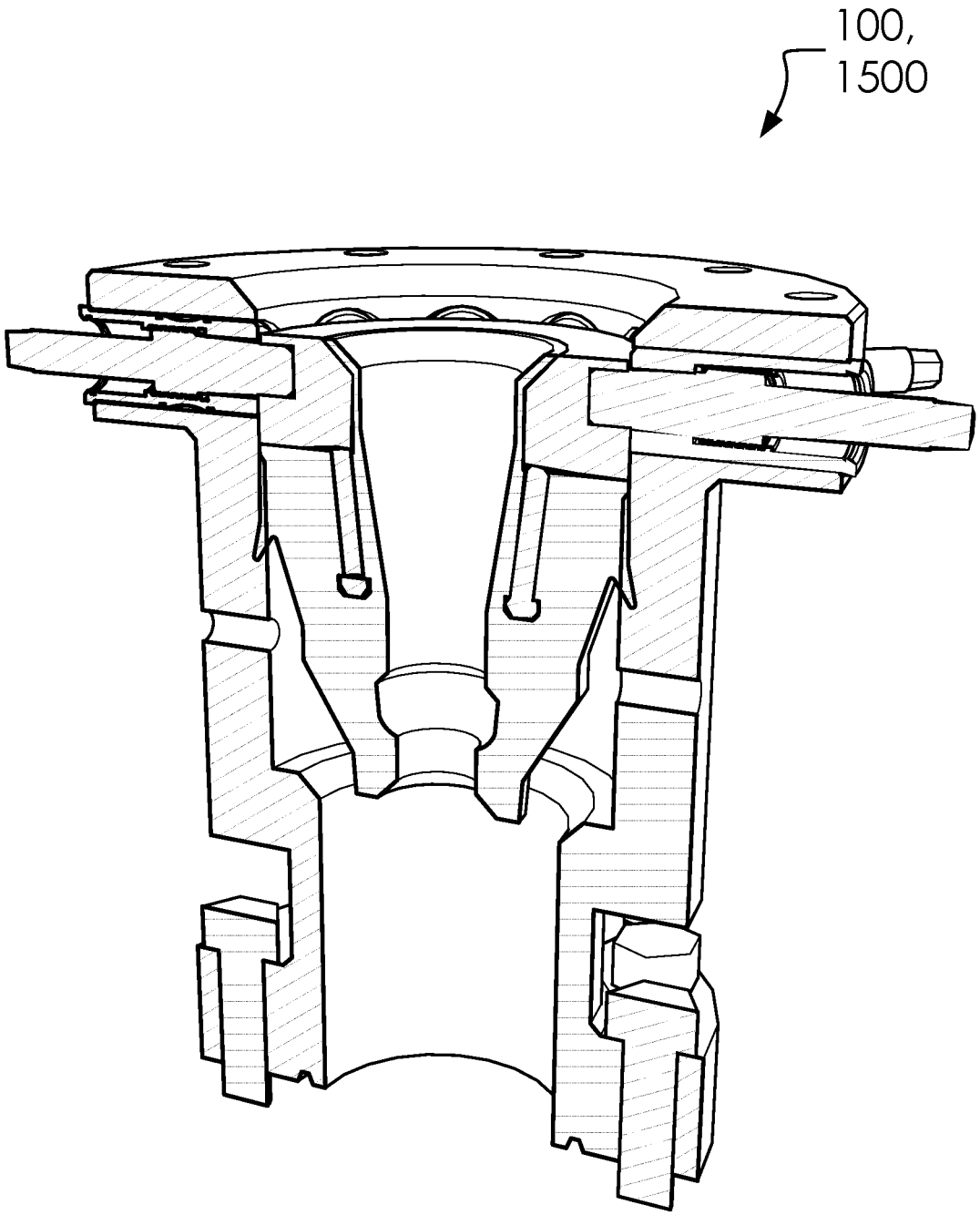
FIG. 15 illustrates an elevated top side view of said stripper head 102 with said one or more retention pin sleeves 110 and said one or more retention pins 112 in x-ray view.

FIG. 15 illustrates an elevated top side view of said stripper head 102 with said one or more retention pin sleeves 110 and said one or more retention pins 112 in x-ray view.

It is noted that FIG. 15 does not comprise details associated with FIG. 11B, such as said one or more O-rings 1108, said bushing 1120 and said snap ring 1122.

The following sentences are generated from the claims and represent at least one embodiment of the current disclosure: said stripper head assembly 100 for holding back pressure while stripping work-strings in and out of pressurized well environments, wherein, said stripper head assembly 100 comprises said stripper head 102, said stripper insert 106, said stripper rubber 108, and said one or more retention pins 112. Said stripper head 102 comprises an outer portion of said stripper head assembly 100. Said stripper head 102 comprises, from top to bottom, said top portion 208, said body portion 206, said lower neck portion 204 and said flange base 202. A portion of said stripper insert 106 fits within a portion of said stripper rubber 108. A portion of said stripper rubber 108 fits within a portion of said stripper head 102. A portion of said one or more bolts 104 attaches to a portion of said stripper head 102. A portion of said one or more retention pin sleeves 110 fits within a portion of said stripper head 102. A portion of said one or more retention pins 112 fits within a portion of said one or more retention pin sleeves 110. Said stripper rubber 108 comprises a rubber material. Said one or more retention pins 112 selectively slide into said one or more retention apertures 210 of said stripper head 102 and press into a side portion of said stripper insert 106 to hold said stripper insert 106 and said stripper rubber 108 within said stripper head 102. Said stripper rubber 108 comprises a form fitting element for use within said stripper head assembly 100 being defined with:

said lower aperture 716 and said upper aperture 718 at either end of said center aperture 600, said inner surface 706 around an interior space comprising said center aperture 600, said collar portion 604 attaching to said upper mid portion 606. Said upper mid portion 606 comprising a substantially cylindrical hollow element for selectively being held within said inner sidewall 520 of said stripper insert 106, said lubrication groove 714 cut into a portion of said lower portions 610, said shoulder 738 extending out from said upper mid portion 606 to form said lower mid portion 608, said seal lip 702 comprising an outwardly extending material comprising said pressure trap 740 between said lower mid portion 608 and said lower portions 610, said lower portions 610 extending down toward said lower aperture 716 and forming said multi-stage loading zones 726, and said multi-stage loading zones 726 configured to directing pressures so as to enhance the seal of said stripper rubber 108 within said stripper head assembly 100.

Figure 16:
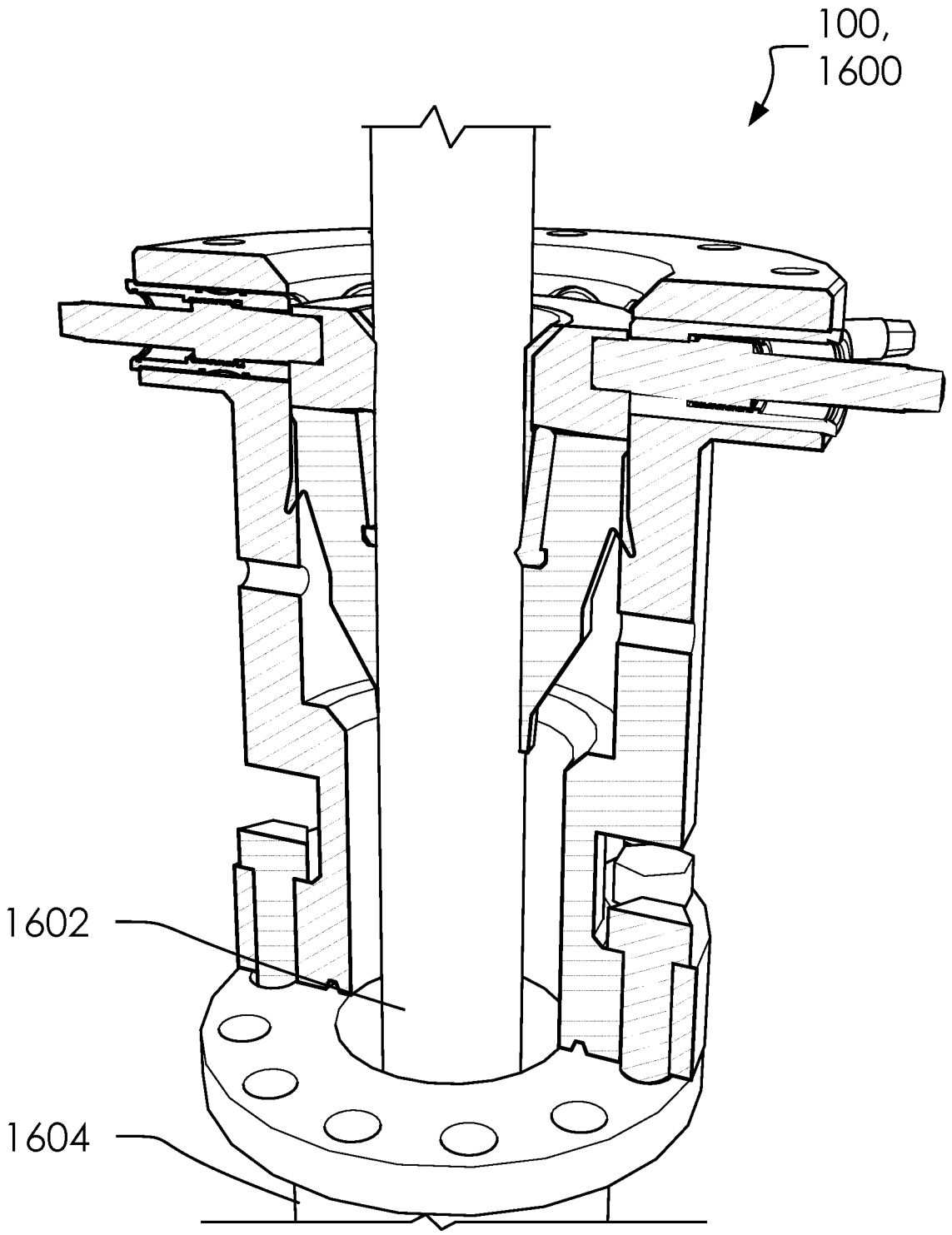
FIG. 16 illustrates a perspective overview of a pressurized well environment 1600 with a cross section overview of said stripper head assembly 100 with a portion of a work-string 1602 and a portion of said pressurized well environment 1600.

FIG. 16 illustrates a perspective overview of a pressurized well environment 1600 with a cross section overview of said stripper head assembly 100 with a portion of a work-string 1602 and a portion of said pressurized well environment 1600.

Figure 17:
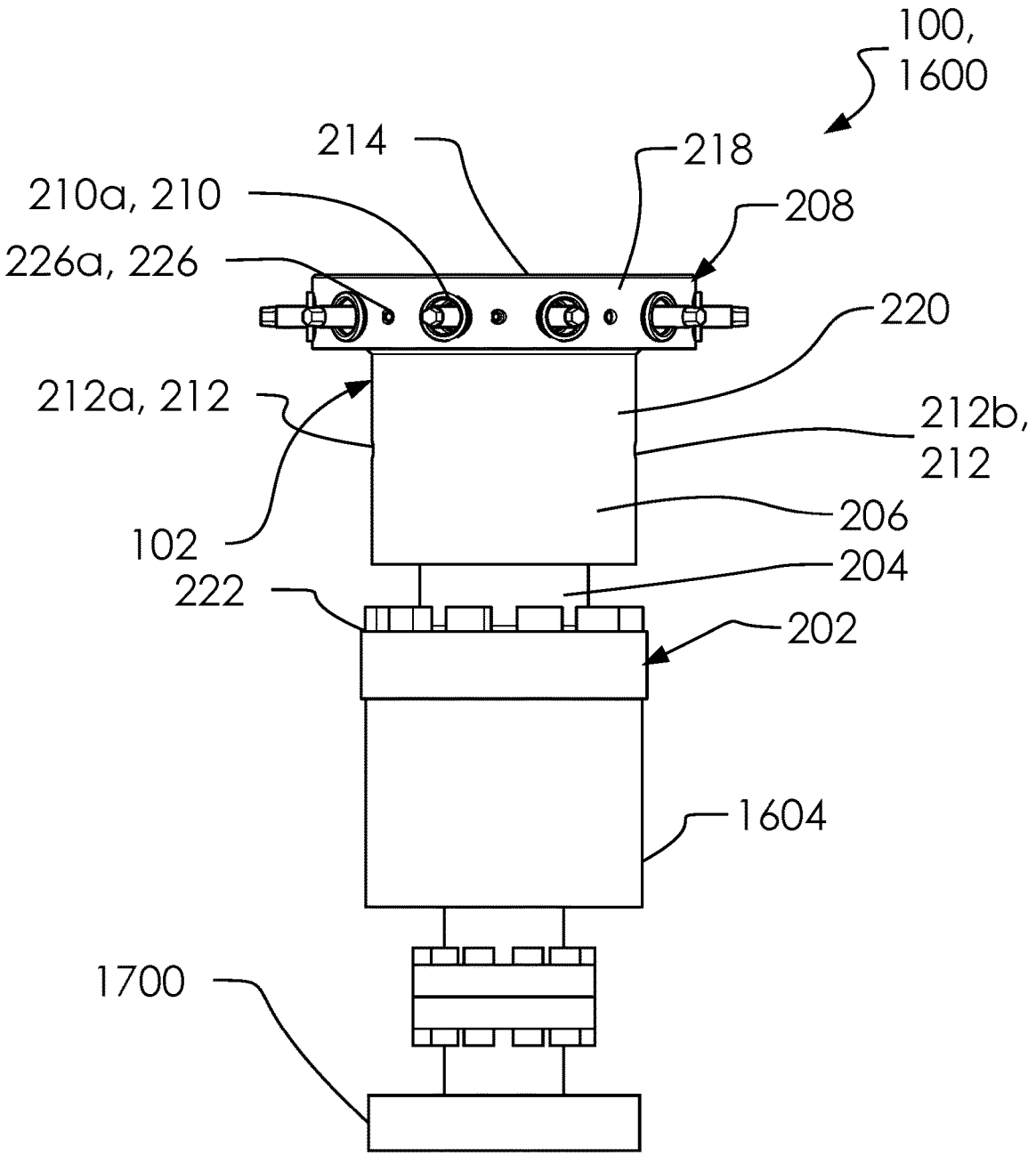
FIG. 17 illustrates an elevated side view of said stripper head assembly 100 in said pressurized well environment 1600.

FIG. 17 illustrates an elevated side view of said stripper head assembly 100 in said pressurized well environment 1600.

In one embodiment said stripper head assembly 100 can attach to a blow-out preventer 1604 which is attached to a well head 1700.

The invention claimed is:

1. A stripper head assembly for holding back pressure while stripping a work-string in and out of a pressurized well environment, wherein:

said stripper head assembly comprises a stripper head, a stripper insert, a stripper rubber, and one or more retention pins;

said stripper head comprises an outer portion of said stripper head assembly;

said stripper head comprises, from top to bottom, a top portion, a body portion, a lower neck portion and a flange base;

a portion of said stripper insert fits within a portion of said stripper rubber;

a portion of said stripper rubber fits within a portion of said stripper head;

a portion of one or more bolts attach said flange base of said stripper head assembly equipment attached to a well head at said pressurized well environment, including a blow out preventer;

said stripper rubber comprises a rubber material;

said stripper rubber comprises a form fitting element for use within said stripper head assembly;

said stripper rubber comprises a lower aperture and an upper aperture at either end of a center aperture;

said stripper rubber comprises an inner surface around an interior space comprising said center aperture;

said stripper rubber comprises a collar portion attaching to an upper mid portion;

said upper mid portion comprises a substantially cylindrical hollow element for selectively being held within an inner sidewall of said stripper insert;

a lower portions of said upper mid portion extend down toward said lower aperture and forming a multi-stage loading zones, and said multi-stage loading zones are configured to directing pressures to enhance a seal of said stripper rubber within said stripper head assembly.

2. The stripper head assembly of claim 1, wherein:

said stripper head assembly comprises several components which selectively nest within one another; wherein, a portion of said stripper insert is configured to fit within a portion of said stripper rubber;

a portion of said stripper rubber is configured to fit within a portion of said stripper head;

a portion of said one or more bolts is configured to attach to a portion of said stripper head;

a portion of one or more retention pin sleeves fit within a portion of said stripper head; and a portion of said one or more retention pins fit within a portion of said one or more retention pin sleeves.

3. The stripper head assembly of claim 1, wherein:

said stripper head further comprises one or more grease ports.

4. The stripper head assembly of claim 1, wherein:

a side surface of said stripper head comprises one or more NPT (National Pipe Thread) outlets; and said one or more NPT outlets are used for pressure equalization and bleed-off.

5. The stripper head assembly of claim 1, wherein:

said upper mid portion comprises a lubrication groove cut into a portion of said lower portions, a shoulder extending out from said upper mid portion to form a lower mid portion, and a seal lip comprising an outwardly extending material comprising a pressure trap between said lower mid portion and said lower portions.

6. The stripper head assembly of claim 1, wherein:

a portion of said one or more retention pin sleeves fits within a portion of said stripper head;

a portion of said one or more retention pins fits within a portion of said one or more retention pin sleeves; and said one or more retention pins selectively slide into one or more retention apertures of said stripper head and press into a side portion of said stripper insert to hold said stripper insert and said stripper rubber within said stripper head.

7. The stripper head assembly of claim 6, wherein:

said stripper insert is molded into said stripper rubber and bonded together through an injected rubber molding process.

8. The stripper head assembly of claim 1, wherein:

said stripper head, said one or more bolts, said one or more retention pin sleeves and said one or more retention pins are constructed of metals such as steel.

9. The stripper head assembly of claim 1, wherein:

said stripper insert comprises an insert upper ring, one or more stalks, and an insert lower ring;

said stripper insert is configured to fit within a portion of said stripper rubber;

wherein, said one or more stalks and said insert lower ring is configured to nest within said stripper rubber;

said one or more stalks comprises cylindrical elements expending down from a lower portion of said insert upper ring;

said insert lower ring comprises a portion of said insert upper ring having been cut away; and said insert lower ring comprises a substantially circular element adapted to prevent movement of said stripper insert relative to said stripper rubber once attached thereto.

10. The stripper head assembly of claim 9, wherein:

said insert upper ring comprises an anti-rotation tab adapted to prevent rotation of said stripper insert with a portion of said one or more retention pins inserted into a portion of said insert upper ring.

11. The stripper head assembly of claim 10, wherein:

said insert upper ring, said one or more stalks, said anti-rotation tab and said insert lower ring are welded to one another.

12. The stripper head assembly of claim 11, wherein:

said anti-rotation tab is inserted into a portion of an indention to block off a portion of said indention;

a plurality of said anti-rotation tab is used, as needed; and said anti-rotation tab is welded into a portion of said indention.

13. The stripper head assembly of claim 12, wherein:

said one or more stalks is arranged at a stalk angle inward and down toward a center aperture to provide an interference fit of said stripper head assembly when no pressure is applied to the system and to provide a press said stripper rubber in ward when under pressure.

14. The stripper head assembly of claim 1, wherein:

said stripper rubber comprises a form fitting element for use within said stripper head assembly being defined with said lower aperture and said upper aperture at either end of said center aperture;

said inner surface around an interior space comprising said center aperture;

said collar portion attaching to said upper mid portion;

said upper mid portion comprising a substantially cylindrical hollow element for selectively being held within said inner sidewall of said stripper insert;

said lubrication groove cut into a portion of said lower portions;

said shoulder extending out from said upper mid portion to form said lower mid portion;

said seal lip comprising an outwardly extending material comprising said pressure trap between said lower mid portion and said lower portions;

said lower portions extending down toward said lower aperture and forming said multi-stage loading zones; and said multi-stage loading zones configured to directing pressures so as to enhance the seal of said stripper rubber within said stripper head assembly.

15. The stripper head assembly of claim 14, wherein:

said pressure trap comprises an internal taper;

said internal taper is configured to create an early seal with an internal surface of said stripper head;

said pressure trap is self-energized to press said seal lip into said internal surface;

said seal lip is configured to have enough initial contact to create an initial seal which is configured to then hold; and said self-energized is configured such that said stripper rubber need not be compressed or squeezed at installation to create the initial seal.

16. The stripper head assembly of claim 15, wherein:

said internal taper of said pressure trap is configured to tighten under pressure as said pressure trap will enhance a seal with said internal surface under pressure.

17. The stripper head assembly of claim 16, wherein:

said internal taper of said pressure trap is configured to tighten under pressure as said pressure trap will enhance the seal with said internal surface under pressure;

said multi-stage loading zones is configured to hold on a tubing within said stripper head assembly by increasing the cross-section thickness of a stripper rubber as said multi-stage loading zones increase from a first stage to a second stage to a third stage to a fourth stage;

the relative angle of said fourth stage and said second stage convert pressure into inward force on tubing; and pressure on said fourth stage is configured to assert pressure on said insert lower ring and said one or more stalks within said stripper rubber.

* * * * *